US005809913A

United States Patent [19]

Kramer et al.

[11] Patent Number: 5,809,913

[45] Date of Patent: Sep. 22, 1998

[54] CORROSION PROTECTION FOR UTILITY BOILER SIDE WALLS

[75] Inventors: Edward D. Kramer, Evansville, Ind.; Joseph A. Urich, Allison Park, Pa.; Keith S. Lochart, Lawrenceville, Ill.; Bernard P. Breen, Pittsburgh, Pa.; James E. Gabrielson, Hanover, Minn.

[73] Assignees: Cinergy Technology, Inc., Plainfield, Ind.; Energy Systems Associates, Pittsburg, Pa.

[21] Appl. No.: 730,581

[22] Filed: Oct. 15, 1996

[51] Int. Cl.[6] ..... F23L 17/00; F23B 7/00

[52] U.S. Cl. ..... 110/347; 110/348; 110/345; 110/343; 431/8; 431/10

[58] Field of Search ..... 431/8, 10, 174, 431/178, 179; 110/203, 210, 211, 212, 214, 234, 263, 265, 297, 336, 341, 342, 343, 344, 345, 347, 348, 147

[56] References Cited

U.S. PATENT DOCUMENTS

| | | | |
|---|---|---|---|
| 1,729,024 | 9/1929 | Bell | 110/347 |
| 1,739,594 | 12/1929 | Jackson | 431/10 |
| 1,795,951 | 3/1931 | Jacques | 431/178 |
| 2,573,910 | 11/1951 | Kreisinger | 110/344 |
| 3,877,440 | 4/1975 | Winkin | 122/235 B |
| 4,021,186 | 5/1977 | Tenner | 431/10 |
| 4,596,198 | 6/1986 | Greskovich et al. | 110/347 |
| 4,969,408 | 11/1990 | Archer et al. | 110/347 |
| 5,022,331 | 6/1991 | Simonen | 110/297 |
| 5,121,700 | 6/1992 | Blackwell et al. | 110/348 |
| 5,199,357 | 4/1993 | Garcia-Mallol | 110/347 |
| 5,205,226 | 4/1993 | Kitto, Jr. et al. | 110/264 |
| 5,329,866 | 7/1994 | LaRue | 110/265 |
| 5,343,820 | 9/1994 | Marion | 110/264 |
| 5,417,564 | 5/1995 | Briggs | 431/179 |
| 5,429,060 | 7/1995 | Tokuda et al. | 110/263 |
| 5,441,000 | 8/1995 | Vatsky et al. | 110/263 |
| 5,488,916 | 2/1996 | Bozzuto | 110/347 |
| 5,505,146 | 4/1996 | Laursen | 110/264 |
| 5,529,000 | 6/1996 | Hartel et al. | 110/347 |

OTHER PUBLICATIONS

Foster Wheeler, "$NO_x$ Control: The Foster Wheeler Approach," Article by Joel Vatsky, Foster Wheeler Energy Corporation, Clinton, NJ; presented at the EPA/EPRI 1989 Joint Symposium on Stationary Combustion $NO_x$ Control in San Francisco, CA, Mar. 6–9, 1989.

VGB —Conference, "Combustion Technology 1994," Meaurements of Prevention Against Fireside Corrosion; Hufmann et al.

"Development of a Low $NO_x$ Combustion System for a Roof–Fired Utility Boiler," by JP Bionda, R. Glickert, A. Hallo and G.F. Gretz. Presented at the International Joint Power Generation Conference —Oct. 9–11, 1995, Minneapolis, MN (ESA 7252).

*Primary Examiner*—Ira S. Lazarus
*Assistant Examiner*—Ljiljana V. Ciric
*Attorney, Agent, or Firm*—Woodard, Emhardt, Naughton, Moriarty & McNett

[57] ABSTRACT

A method for reducing the rate of side wall corrosion in a coal-fired utility boiler. A plurality of side wall slots are provided in the side walls of the boiler so that a protective layer of air may be introduced through the slots and propelled upward by the updraft from the burners.

10 Claims, 25 Drawing Sheets

CORROSION PROTECTION FOR UTILITY BOILER SIDE WALLS

FIELD OF THE INVENTION

The present invention relates generally to a method of reducing the rate of side wall corrosion of a coal-fired utility boiler.

BACKGROUND OF THE INVENTION

Large coal-fired electric utility generating units commonly utilize steam to turn a turbine and generate electricity. The steam is produced in a boiler having a plurality of walls containing tubes through which water flows. As coal is burned in the boiler interior, heat is transferred into the boiler walls to heat the water contained therein and produce the required steam.

One issue associated with such coal-fired generating units relates to the control of emissions, particularly nitrogen oxides ($NO_x$), which are created by the combustion process. To address this issue it has become common to "stage" the combustion process so that combustion is begun under fuel rich conditions and completed by adding the stoichiometric amount of air downstream from the initial combustion. This fuel rich combustion retards and almost prevents the formation of $NO_x$, either from atmospheric $N_2$ or from fuel bound nitrogen, at the fuel rich locations. The mechanism is so effective that it is applied in almost all low $NO_x$ combustion devices for furnaces and boilers.

Combustion staging can be accomplished by either fuel staging or air staging, with air staging being the more common method. Different methods of air staging include the use of overfire air ports, the use of controlled mixing burners, and operating the unit with some of the burners providing only air and no fuel. In all of these methods part of the combustion proceeds in a fuel rich environment.

The fuel rich environment in which staged combustion proceeds provides a reducing atmosphere in the boiler interior. If the reducing atmosphere contacts the boiler walls before the burnout air is added, side wall corrosion will inevitably follow. The rate of corrosion depends on a variety of factors, including the concentration of reducing gases (such as carbon monoxide and hydrogen sulfide), the temperature of the metal of the side walls, the cycling between operating temperature and ambient temperature, the presence of liquid ash at or near the tube wall, and the cycling between reducing and oxidizing atmospheres.

The cost of repairing or replacing utility boiler side walls damaged by such corrosion is estimated to be in the tens of millions of dollars per year. Accordingly, various methods have been employed in attempts to reduce the corrosion brought about by staged combustion. Some of these methods involve adding air through vents at the bottoms of the side walls with the hope that the air will shield the furnace walls from the fuel rich conditions, while remaining separate from the air that is mixed with the flame until combustion was complete.

As further background, it is known that in the normal combustion process there is an excess of air, and that the combustion products therefore contain $O_2$. The oxygen oxidizes the iron in the tube to $Fe_2O_3$ which forms a tight scale on the tubes that retards the diffusion of additional oxygen or other harmful gases to the tube surface. In this way, the scale prevents or grossly retards additional corrosion. Low pressure boilers, which have low furnace tube metal temperatures as well, sometimes operate for a decade or more without perceptible corrosion. High pressure boilers and especially supercritical steam generators with their high tube metal temperatures may corrode at rates of 5 to 20 mils per year until low $NO_x$ operation is attempted. During low $NO_x$ firing, corrosive metal losses in some areas of high pressure boilers and supercritical steam generators is excessive.

Corrosion rates of 60 to 120 mills per year are often experienced in areas of supercritical units where reducing conditions are occurring. These rates of corrosion are unacceptable. In coal fired or residual oil fired units, the sulfur in the fuel is oxidized to the gas $SO_2$ or reduced to the gas $H_2S$. The $SO_2$ occurs when there is an excess of air and is usually not a problem; however, with carbon it can react with $Fe_2O_3$ in a two stage process to form FeS. The carbon is present as a result of insufficient air or poor mixing. The $H_2S$ is formed from the $SO_2$ and carbon and the fuel by reducing conditions and it reacts with the iron oxide or iron to form FeS. The iron sulfide (FeS) forms a scale which protects the furnace tubes, but it does not protect as well as the iron oxide. Thus, when the FeS is the protective coating, the corrosion is accelerated. The most severe condition occurs when there are alternating conditions of oxidizing and then reducing gases at any location. First, one protective coating and then the other is destroyed. Each reformation of a protective coating takes metals from the iron of the tube. The tube metal is removed by the changing conditions. With the load changing from day time to night time, as is usually the case, it is almost impossible to maintain any wall area in a continuous reducing condition. Corrosion continues very rapidly.

Chlorine corrosion of boiler tubes is also common and serious. For example, in his book *Mineral Impurities in Coal Combustion* (1985), Erich Raask discusses several aspects of chlorine corrosion of furnace walls. Under reducing conditions, HCl will react with the protective oxide layer and hydrogen or carbon monoxide as follows:

$$Fe_2O_3+2HCl+CO=FeO+FeCl_2+H_2O+CO_2$$

$$Fe_3O_4+2HCl+CO=2FeO+FeCl_2+H_2O+CO_2$$

These reactions break down the protective oxide layer, and once the protective layer is rendered porous, HCl, $O_2$, $SO_2$, $H_2S$ and other reactive gases can diffuse rapidly to the tube surface and react to form FeS, FeO, and $FeCl_2$ from the tube metal.

$FeCl_2$ has a high vapor pressure, so it will not accumulate at superheater tube metal surfaces. However, $FeCl_2$ and $FeCl_3$ may accumulate at water tube surfaces. They are both low melting and contribute to the low melting liquid that causes liquid ash attack. Once these materials are formed, they may act as a flux to promote the formation of a liquid phase within the ash deposit.

Some control of the excessive corrosion is possible by selecting alternate metals for furnace tubes, spray coating furnace walls, or chromizing sections of the wall before they are installed. Unfortunately though, these techniques are extremely expensive and the effectiveness of the methods has not been completely established.

In spite of the corrosion problems, air staging of combustion remains the primary method of controlling $NO_x$ emissions from oil and coal fired furnaces and steam generators. Thus, it can be seen that a need continues to exist for an improved method of controlling corrosion of boiler and steam generator side wall tubes. The present invention addresses that need.

SUMMARY OF THE INVENTION

Briefly describing the present invention, there is provided a method for reducing the rate of side wall corrosion in a coal-fired utility boiler. The method preferably comprises providing a plurality of side wall slots in at least one of the boiler side walls, wherein the side wall slots are located substantially above the boiler floor. A flow of "curtain air" is then introduced into the boiler through the side wall slots, wherein the curtain air is introduced into the boiler at a location effective to be propelled upward by the updraft from the burners, and thereby to provide a curtain of air to protect the side walls from corrosion. By taking advantage of the updraft from the burners, the side wall curtain air may be introduced at a velocity low enough to ensure that the side wall air does not mix with the primary combustion air to reduce $NO_x$ abatement.

One object of the present invention is to provide a method of preventing corrosion of utility boiler side walls.

Further objects and advantages of the present invention will be apparent from the following description.

DESCRIPTION OF THE PREFERRED EMBODIMENT

Figure 1:
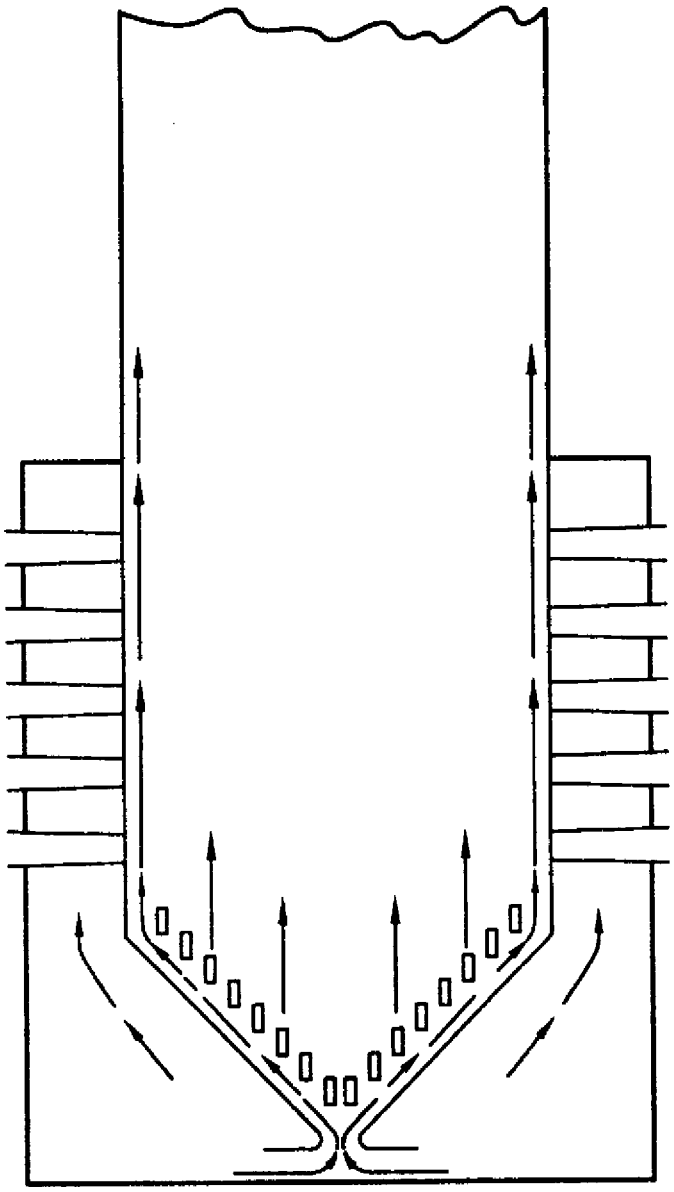
Fig. 1 (Prior Art)
FIG. 1 shows the prior art placement of side wall curtain air vents, which placement does not introduce side wall air at a location effective to be pushed upward by the updraft from the burners.
Figure 2:
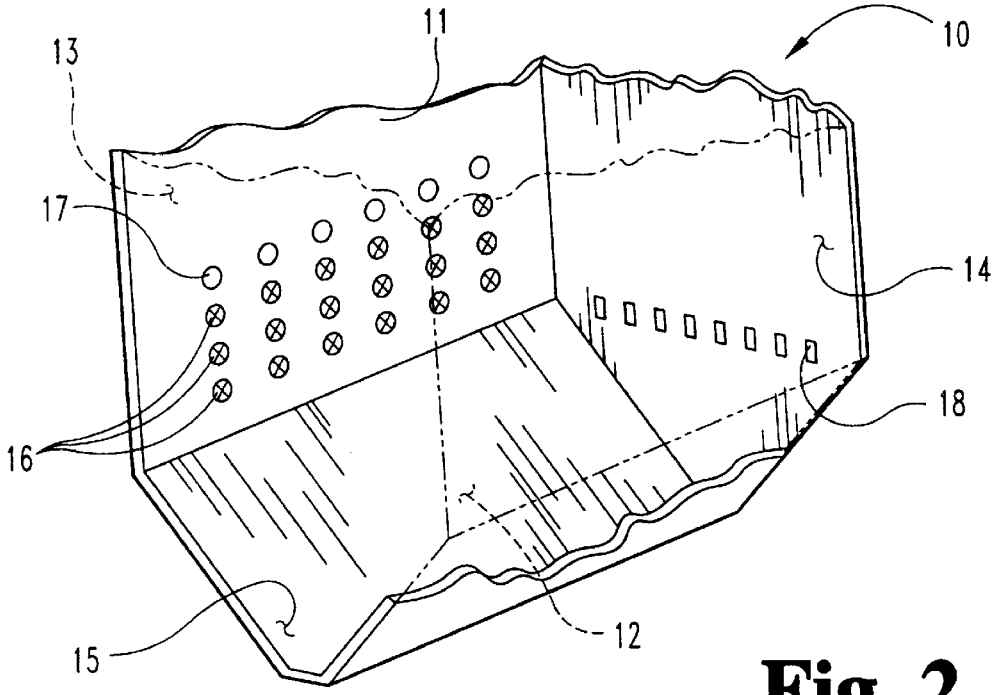
FIG. 2 is a perspective view of an electric utility boiler, showing the placement of the side wall slots of the present invention according to one preferred embodiment.
Figure 4:
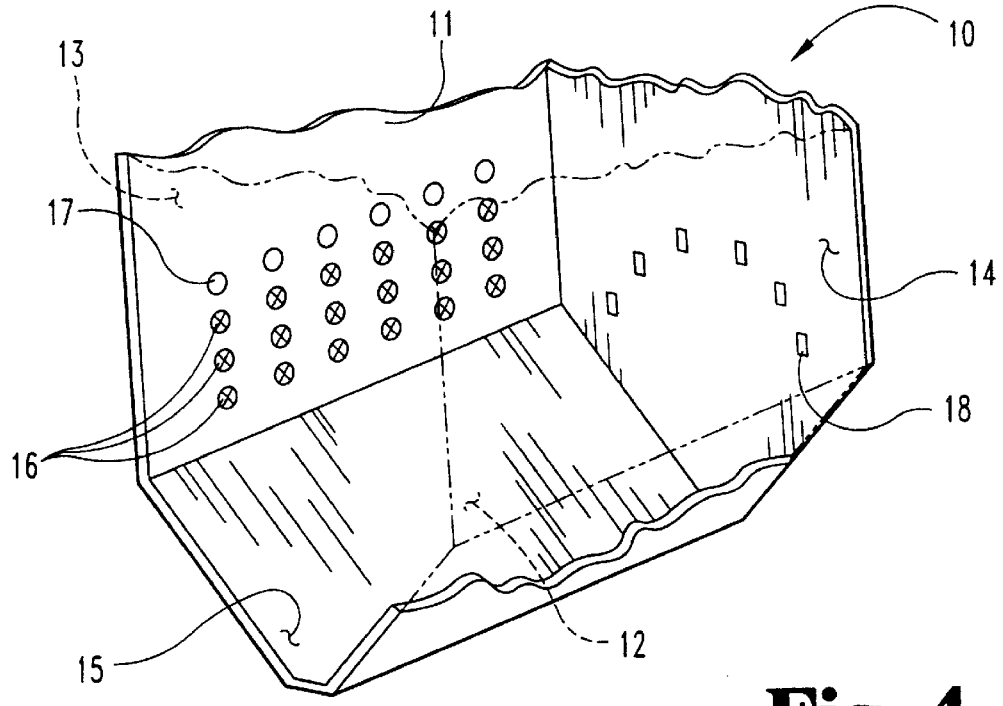
FIG. 4 is a perspective view of an electric utility boiler, showing the placement of the side wall slots of the present invention according to a second preferred embodiment.

For the purpose of promoting an understanding of the principles of the invention, reference will now be made to preferred embodiments and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

As previously indicated, the present invention relates to a method of reducing the rate of side wall corrosion in a coal-fired utility boiler. The inventive method comprises providing side wall air slots located so that a protective curtain of air is introduced into the boiler where the air can be propelled upward by the updraft from the burners. This is in contrast to the prior art method in which the curtain air was introduced into the boiler through side wall slots placed near the floor of the boiler. With the prior art method, the air introduced through the side wall slots was not propelled upward by the updraft provided by the burners, and was therefore ineffective for protecting the side walls from corrosion.

More specifically describing the preferred embodiments, modern steam generator walls are usually formed of tubes which are spaced about two tube diameters apart (center to center) with metal webbing between the tubes The assembly is formed and welded together to make one continuous piece. Water flows up through the tubes and is heated until it becomes steam. The webbing is an integral part of the furnace wall.

With the inventive method, air is ducted to the outside of the tube/webbing barrier, some of the webbing is cut away, and air flows into the furnace through slots (also referred to as ports or vents) between the tubes. The slots, formed by cutting webbing out, are preferably sized to be less than about one inch in width. The air flowing through these slots will not have a great momentum and thus will be turned upward by the flow of combustion products so it will stay near the wall. Thus, a small amount of air will keep a large area of the furnace wall fuel lean. This air can be taken from the overfire air, and this redirection will cause little, if any, increases in $NO_x$ emissions.

Because the side wall air introduced by the inventive method is introduced at a location substantially above the boiler floor, the side wall air does not mix rapidly into the primary flames and does not increase $NO_x$. In fact, it acts very much like overfire air, which as it replaces secondary air, reduces $NO_x$. Since it is introduced with low momentum, it tends to stay near the walls and protect more of the walls.

In one preferred embodiment the side wall slots are provided in a horizontal row at an elevation approximately equal to the elevation of the lowest boiler burners. In another preferred embodiment the side wall slots are provided in an upward arc, with the lowermost portion of the arc (the ends) being positioned at or near the elevation of the lowermost burners. In all embodiments, the slots are positioned to diminish both the area and the severity of the reducing conditions. The slots are therefore designed and positioned so that the side wall air is pushed back and up against the wall. Air that penetrates will not protect the wall, and if it mixes in under the burners it will defeat the low $NO_x$ staging. Accordingly, the side wall slots of the present invention are sized and positioned to avoid mixing in under the burners.

It is also to be appreciated that the present invention may be provided to a boiler equipped with overfire air ports. In that case, ducting appropriate to redirect a portion of the secondary air from the overfire air ports to the slot air slots is also provided. In this embodiment, up to about one-half of the overfire air is redirected to the side wall slots. Thus, while the conventional overfire air technology directs about 20% of the total air through the overfire air ports, in the inventive embodiments about 5% to about 15% of the total air is provided through the overfire air ports, and about 5% to about 15% of the total air is provided through the side wall slots.

It is also to be appreciated that the flow of air through the overfire air ports and the side wall slots should be balanced to minimize $NO_x$ emissions as well as to minimize the rate of corrosion. If too much air is introduced through the overfire air ports the rate of corrosion will be too great. If too much air is introduced through the side wall slots the volume of $NO_x$ emissions will be too great.

In one preferred embodiment the boiler is additionally equipped with boundary air ports located on the front and/or rear walls between the burners and the side walls. These boundary air ports are similar to the side wall slots in that they provide a protective layer of air to shield the side walls from the reducing atmosphere existing near the burners.

In one preferred embodiment of the present invention, a computational fluid dynamics (CFD) model is used to determine the reducing areas in a furnace. The CFD model is then additionally used with slot air of various amounts in alternate locations to find if the new air flow will control the fuel rich conditions. Through this method the appropriate number and location of slots is identified, and the appropriate air pressure is determined.

In performing the CFD analysis it was determined that the most severe corrosion problems occurred where the reducing atmosphere was the strongest, and particularly where the fuel mixture ratio was greater than 115% of the stoichiometric mixture (i.e., where the ratio of fuel to total atmosphere was greater than 115% of the stoichiometric ratio). Accordingly, in one preferred embodiment the side wall slots are sized and positioned to minimize the side wall area being contacted by an atmosphere having a fuel mixture ratio of greater than 115% of the stoichiometric ratio.

Referring now to the drawings, boiler 10 preferably includes a front wall 11, a rear wall 12, a first side wall 13 and a second side wall 14. A floor 15 is also included, and may be downward sloping to provide a hopper for slag collection.

A plurality of burners 16 are included in front wall 11 and/or rear wall 12. Preferably, the burners are located in an array of columns and rows to provide adequate flame to heat the boiler interior. Overfire air ports 17 may also be included, particularly when low-$NO_x$ burners have not been installed.

The side wall slots 18 are positioned in one or more of the side walls 13 and 14. The side wall slots are positioned to that the side wall air introduced therethrough will catch the updraft from the burners and push the side wall air up against the side walls. In one preferred embodiment the side wall slots 18 are arranged in one or more horizontal rows at or near the elevation of the lowermost burner. In another preferred embodiment the side wall slots 19 are arranged in one or more arcs, with the lowermost side wall slot (preferably near the end of the arc) at or near the elevation of the lowermost burner.

Figure 3:
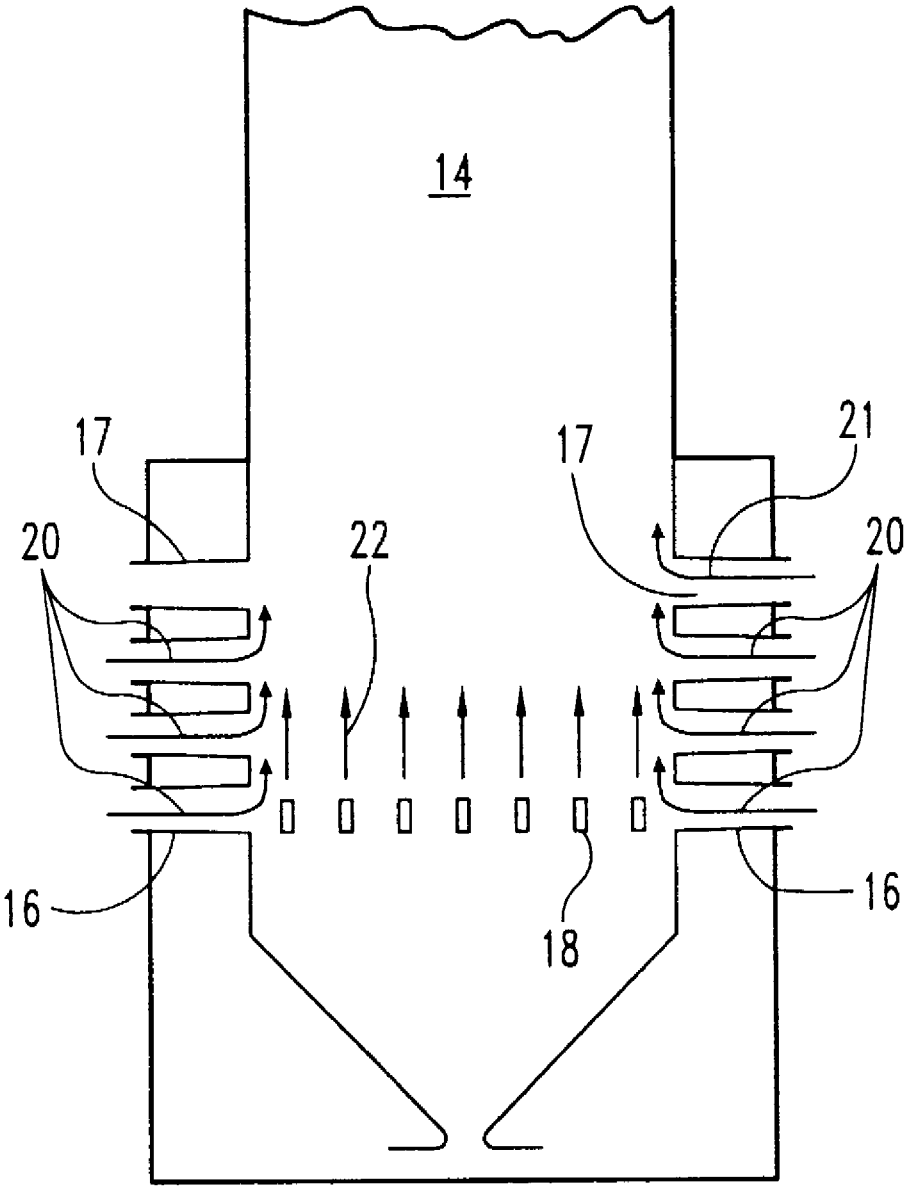
FIG. 3 is an elevational view of an electric utility boiler, showing the placement of the side wall slots of the present invention according to one preferred embodiment.
Figure 5:
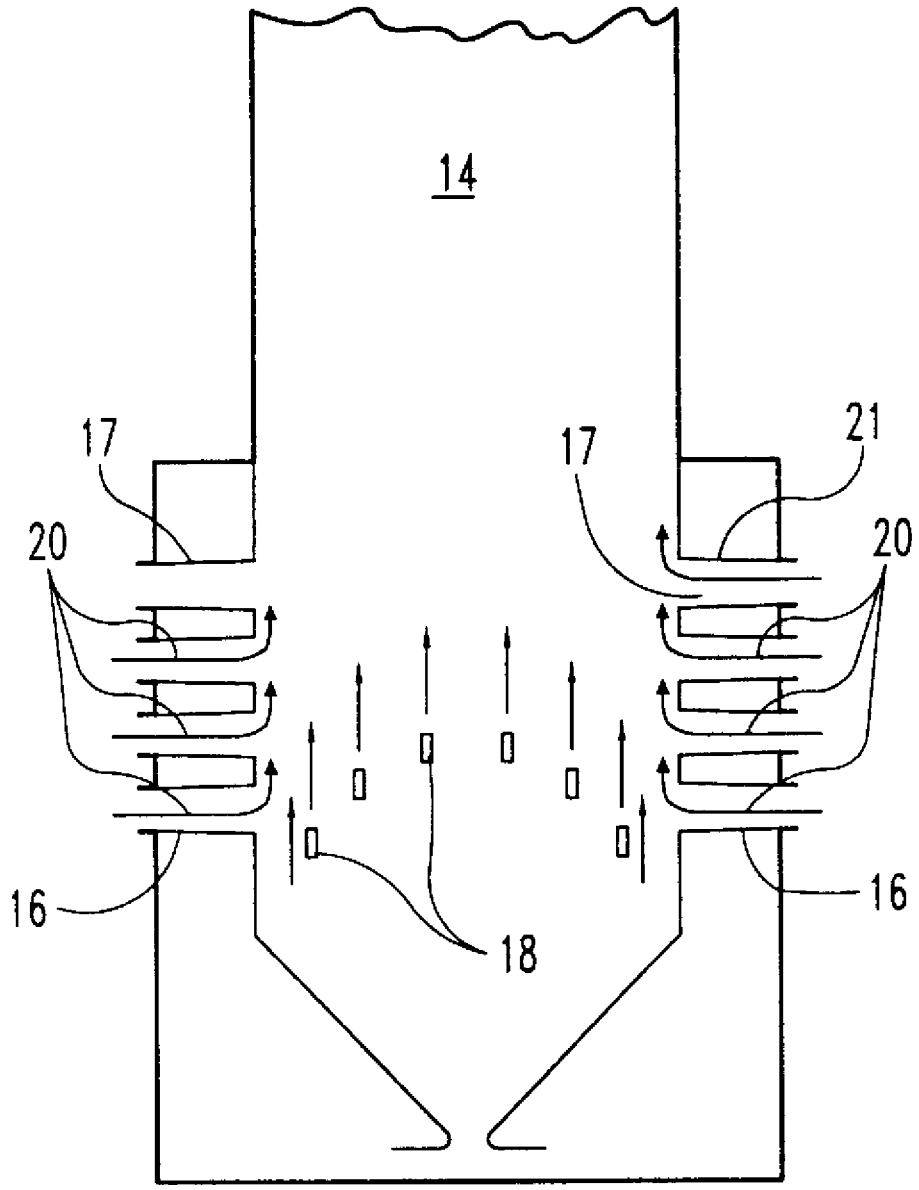
FIG. 5 is an elevational view of an electric utility boiler, showing the placement of the side wall slots of the present invention according to a second preferred embodiment.
Figure 6:
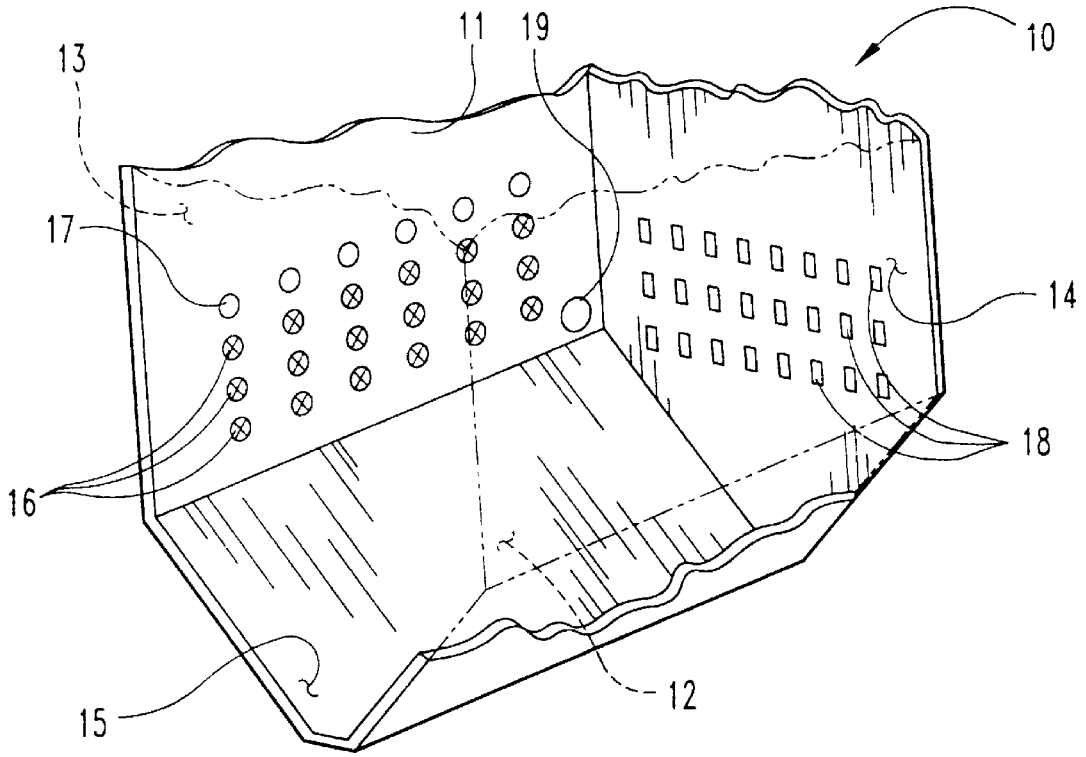
FIG. 6 is a perspective view of an electric utility boiler, showing the placement of boundary air ports and the side wall slots of the present invention, according to one preferred embodiment.
Figure 7:
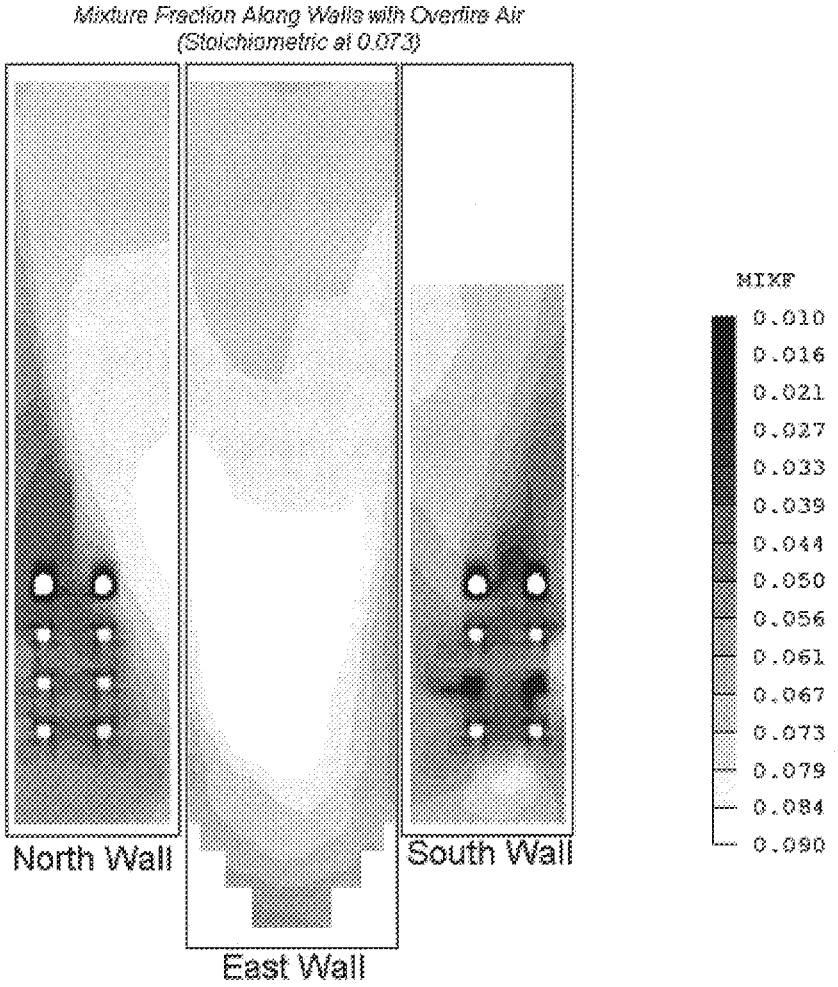
FIG. 7 shows the contours of the fuel mixture fractions of the atmosphere contacting the front (north), rear (south) and side (east) walls of a boiler when operated under the conditions of Example 1.
Figure 8:
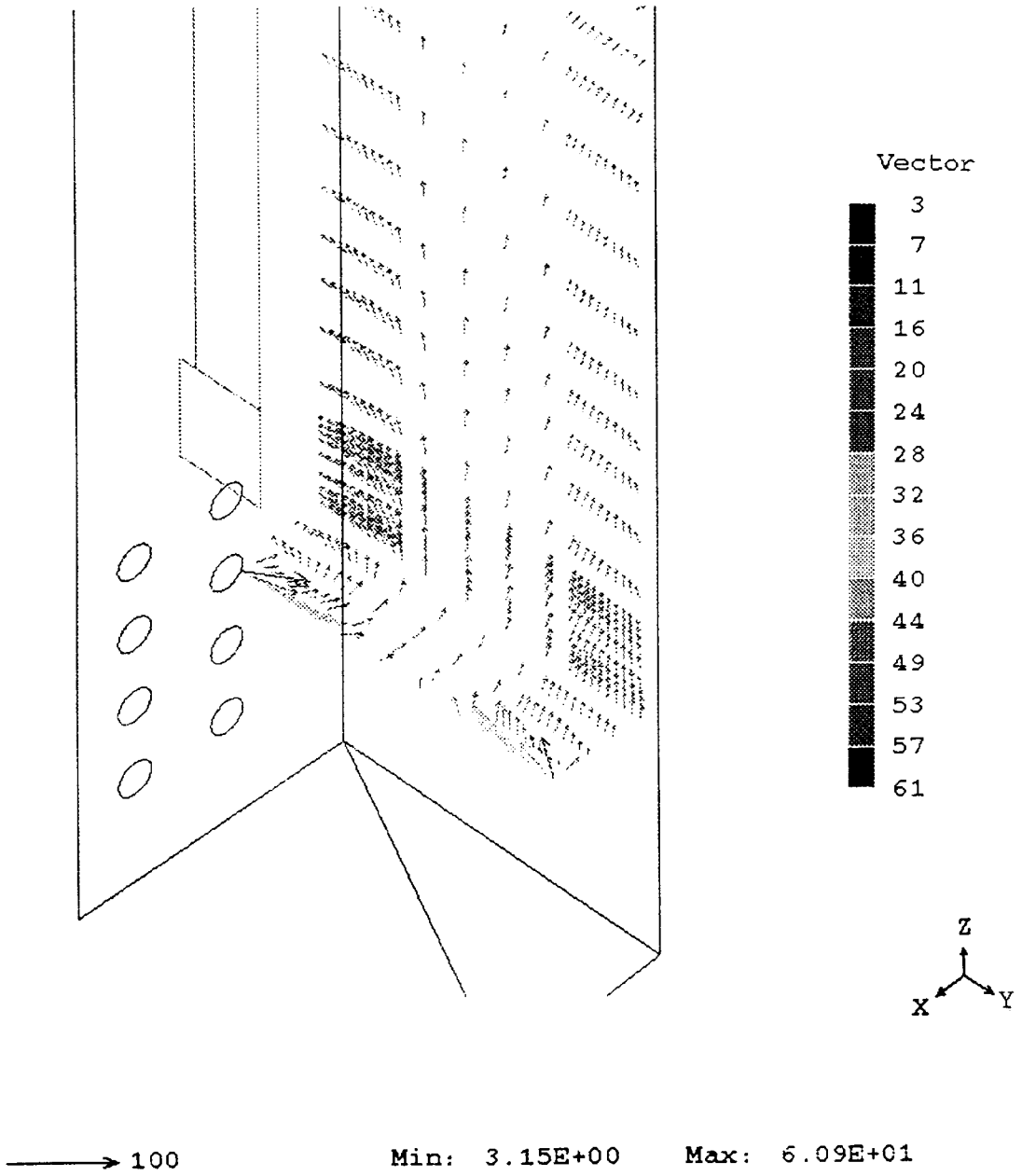
FIG. 8 shows the flow field developed in the side wall and corner from the top burner and up, showing how the burner streams collide at the center and flow toward the wall, creating a spreading effect on the side wall.
Figure 9:
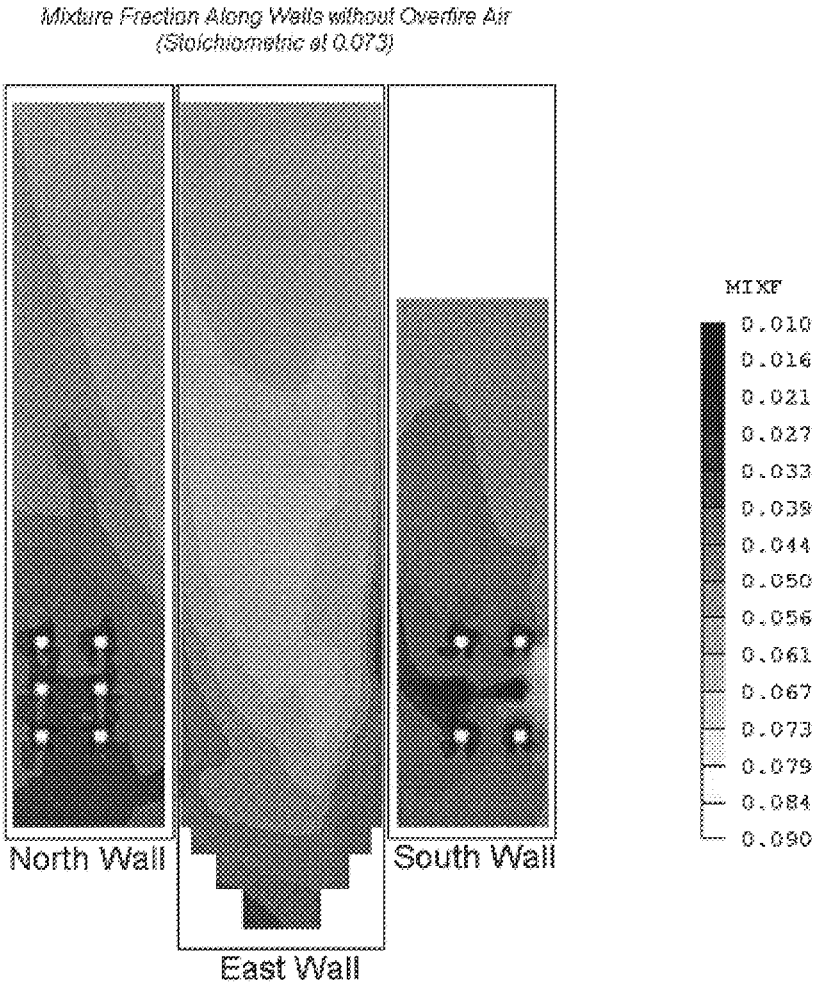
FIG. 9 shows the contours of the fuel mixture fractions of the atmosphere contacting the front (north), rear (south) and side (east) walls of a boiler when operated under the conditions of Example 2.
Figure 10:
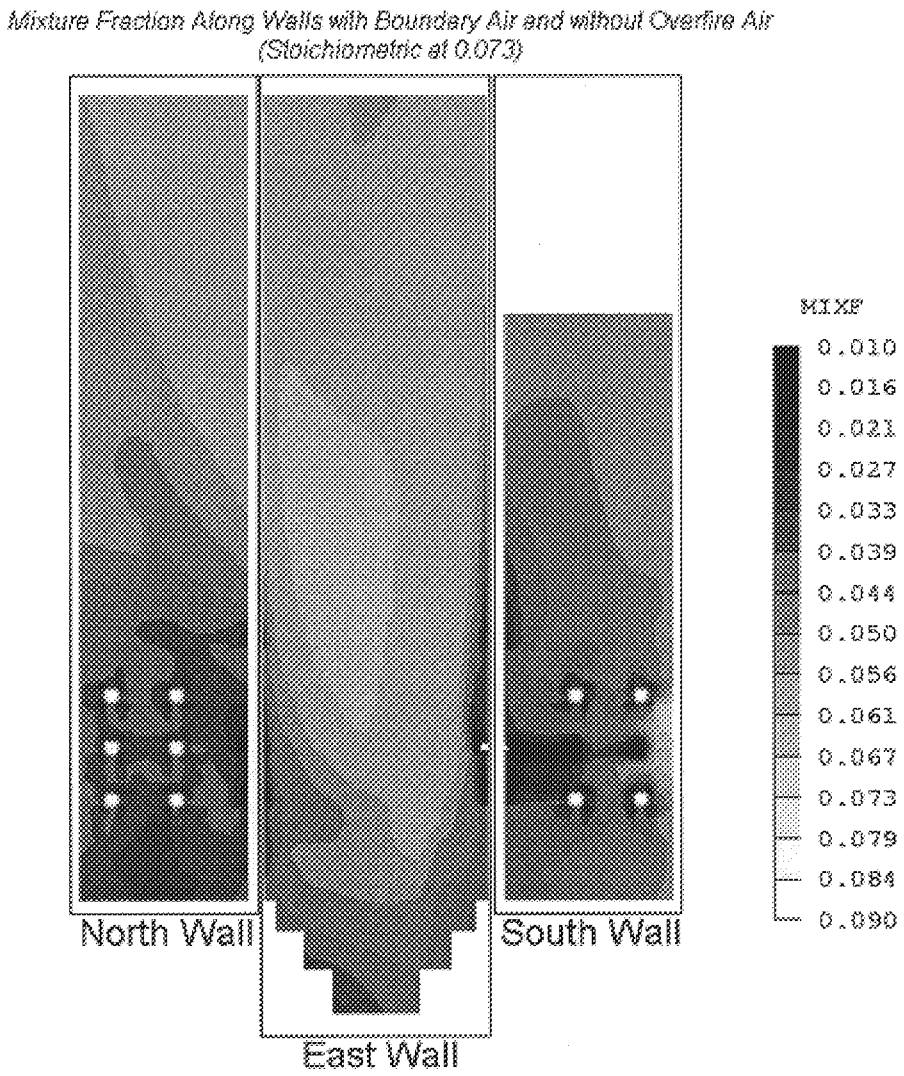
FIG. 10 shows the contours of the fuel mixture fractions of the atmosphere contacting the front (north), rear (south) and side (east) walls of a boiler when operated under the conditions of Example 3.
Figure 11:
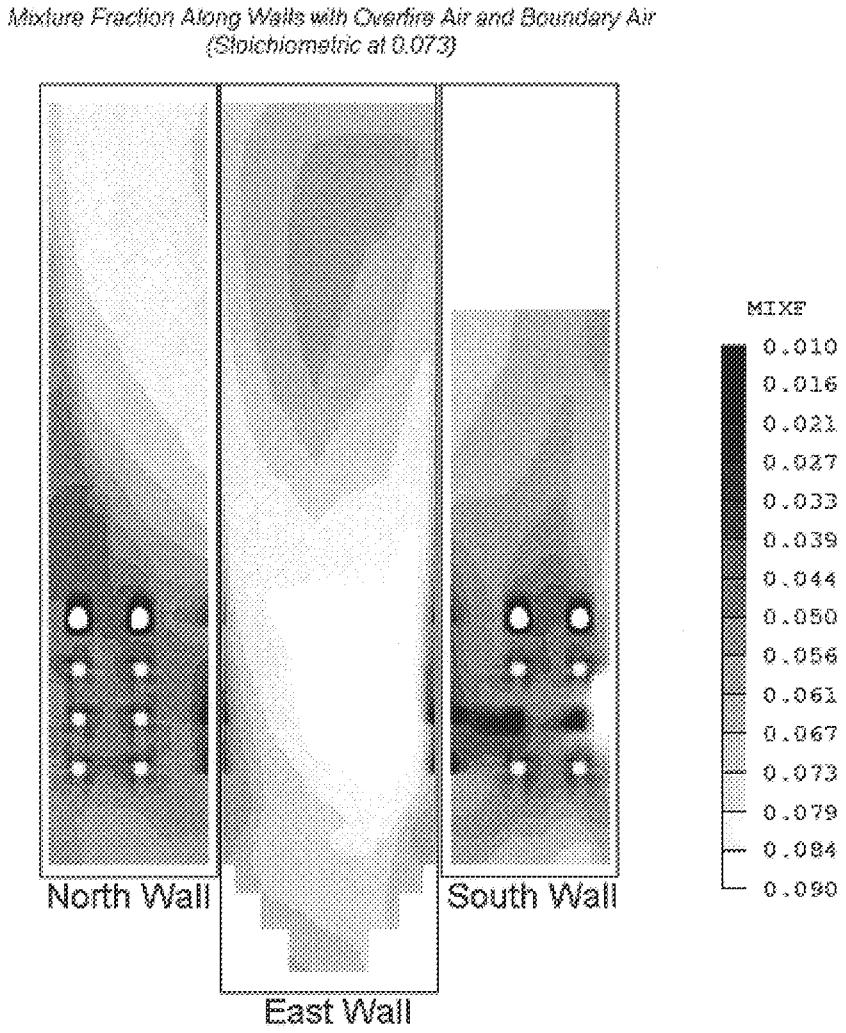
FIG. 11 shows the contours of the fuel mixture fractions of the atmosphere contacting the front (north), rear (south) and side (east) walls of a boiler when operated under the conditions of Example 4.
Figure 12:
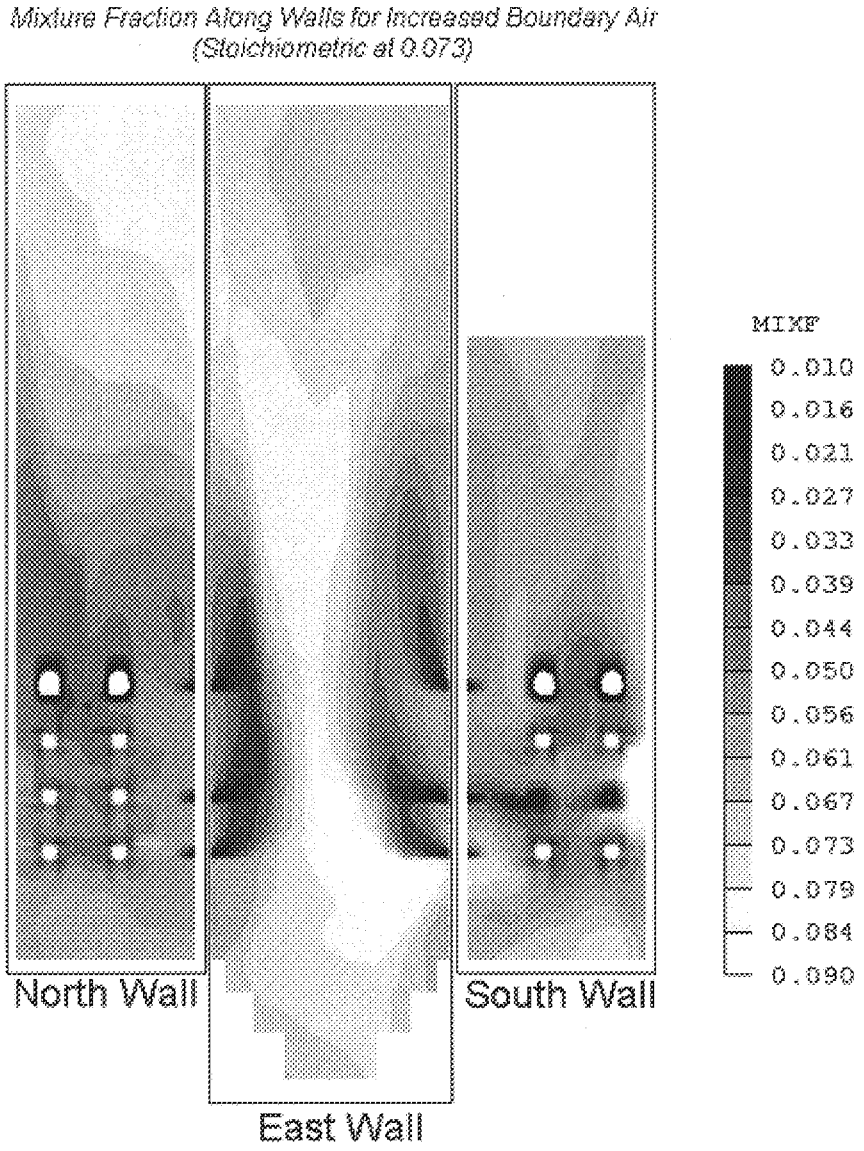
FIG. 12 shows the contours of the fuel mixture fractions of the atmosphere contacting the front (north), rear (south) and side (east) walls of a boiler when operated under the conditions of Example 5.

In FIGS. 3 and 5, the flow of air from the burners is shown by arrows 20, and the flow of overfire air is shown by arrows 21. The flow of air from the side wall slots is shown by arrows 22. Thus, it can be seen that the air flowing through the side wall slots catches the updraft from the burners, and is held against the side walls to protect the same. Because the side wall slots are positioned well above the floor, the side wall air does not mix with the primary air to reduce air staging.

Reference will now be made to specific examples using the processes described above. It is to be understood that the examples are provided to more completely describe preferred embodiments, and that no limitation to the scope of the invention is intended thereby.

EXAMPLE 1

Example 1 shows the prior art embodiment wherein no side wall slots are provided to the boiler. The input conditions are given in the table below, and illustrate a highly corrosive case. The unit modelled in this example has an existing set of boundary air ports to introduce air to the side wall. There is one port corresponding to each of the burner elevations (from the original design, prior to the low $NO_x$ retrofit).

For this case, it was assumed that the existing boundary air ports were completely plugged and supplied no air to the walls. Therefore, this case represented the worst case scenario for the current operation.

| Example 1 | |
|---|---|
| Load | 640 MW |
| Exit $O_2$ | 3.0 |
| Boundary Air | None |
| OFA | 22% |
| Fuel Rich Area | 10,430 $ft^2$ |
| Exit $NO_x$ | 314 ppm |
| Exit $NO_x$ | 0.436 lb/$10^6$ Btu |

EXAMPLE 2

Example 2 duplicates the conditions of Example 1 except that overfire air was set to zero. Setting the overfire air to zero removes the staging in the furnace. This results in very little area of the side walls being exposed to reducing conditions. As can be seen from the Table, the elimination of overfire air causes $NO_x$ levels to be higher than currently acceptable limits.

| Example 2 | |
|---|---|
| Load | 640 MW |
| Exit $O_2$ | 3.0 |
| Boundary Air | None |
| OFA | None |
| Fuel Rich Area | 45 $ft^2$ |
| Exit $NO_x$ | 416 ppm |
| Exit $NO_x$ | 0.578 lb/$10^6$ Btu |

EXAMPLE 3

Example 3 duplicates the conditions of Example 2, but assumes that the existing boundary air ports are functional. The conditions for the case are summarized in the table below.

| Example 3 | |
|---|---|
| Load | 640 MW |
| Exit $O_2$ | 3.0 |
| Boundary Air | Existing - 2% |
| OFA | None |
| Fuel Rich Area | 45 $ft^2$ |
| Exit $NO_x$ | 417 ppm |
| Exit $NO_x$ | 0.579 lb/$10^6$ Btu |

In this example the existing boundary ports are fed from the windbox through a six inch diameter pipe. This six inch diameter was used to calculate the area of the opening in the windbox and to determine the amount of air introduced. This calculation resulted in two percent of the furnace air being introduced through the boundary ports.

Because the boundary ports were located at the same elevations as the original burner placement, it can be assumed that their original purpose was to protect the side wall from the burner flames. With the overfire air inactive and the boundary ports in place, the side wall is almost completely oxidizing.

EXAMPLE 4

Example 4 duplicates the conditions of Example 1, but assumes that the existing boundary air ports are functional. The conditions for the case are summarized in the table below.

| Example 4 | |
|---|---|
| Load | 640 MW |
| Exit $O_2$ | 3.0 |
| Boundary Air | Existing - 2% |
| OFA | 25% |
| Fuel Rich Area | 7,050 $ft^2$ |
| Exit $NO_x$ | 319 ppm |
| Exit $NO_x$ | 0.443 lb/$10^6$ Btu |

Example 4 serves as the baseline for comparison with the inventive side wall air examples, and is therefore used for validation comparisons. Historical observations show that the region predicted to have a mixture fraction above 0.084 corresponds to the regions of the side walls known to experience high tube wastage rates. For this example, a fuel mixture ratio of about 0.073 represents the stoichiometric mixture ratio.

The region above 0.084 is shown in the wall plots by the darkest shading. Based on the validation to historical data, one criterion for a successful design is removal of the area with a mixture fraction above 0.084 (indicated in the plots as dark shading).

EXAMPLE 5

Example 5 illustrates an increase in the existing boundary air. For this case, the boundary air flow was increased to 10% of the secondary air, or 8.5% of the total air. The additional air was modelled as being redirected from the overfire air, not the burners. The conditions for the case are summarized in the table below.

| Example 5 | |
|---|---|
| Load | 640 MW |
| Exit $O_2$ | 3.0 |
| Boundary Air | Existing - 8.5% |
| OFA | 18% |
| Fuel Rich Area | 5,166 $ft^2$ |
| Exit $NO_x$ | 303 ppm |
| Exit $NO_x$ | 0.421 lb/$10^6$ Btu |

This additional air was successful in reducing the area of total area exposed to reducing conditions. However, there still exists an area in the center of the side wall that is exposed to strong reducing conditions. The increased air flow from the existing locations has squeezed the fuel richness toward the center of the wall.

EXAMPLE 6

Figure 13:
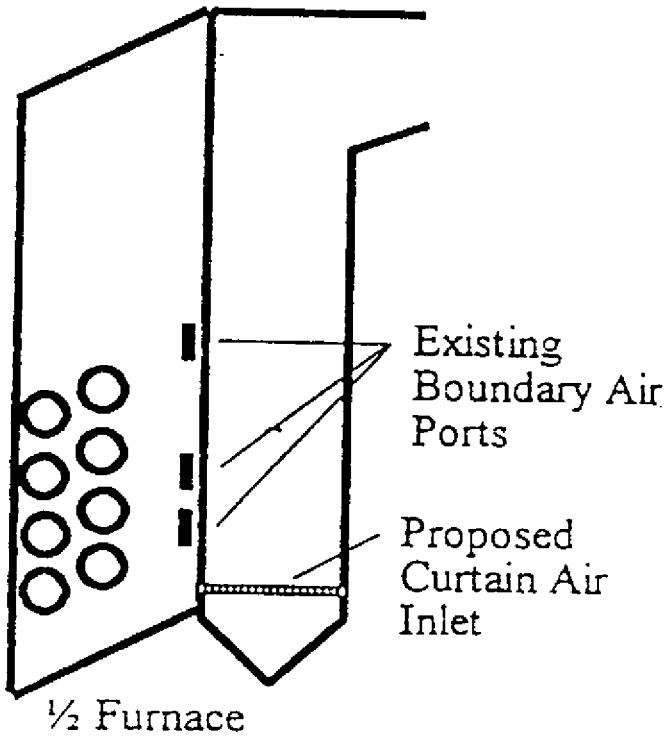
FIG. 13 shows a utility boiler having boundary air ports and side wall slots positioned to introduce side wall air at a location effective to be pushed upward by the updraft from the burners.
Figure 14:
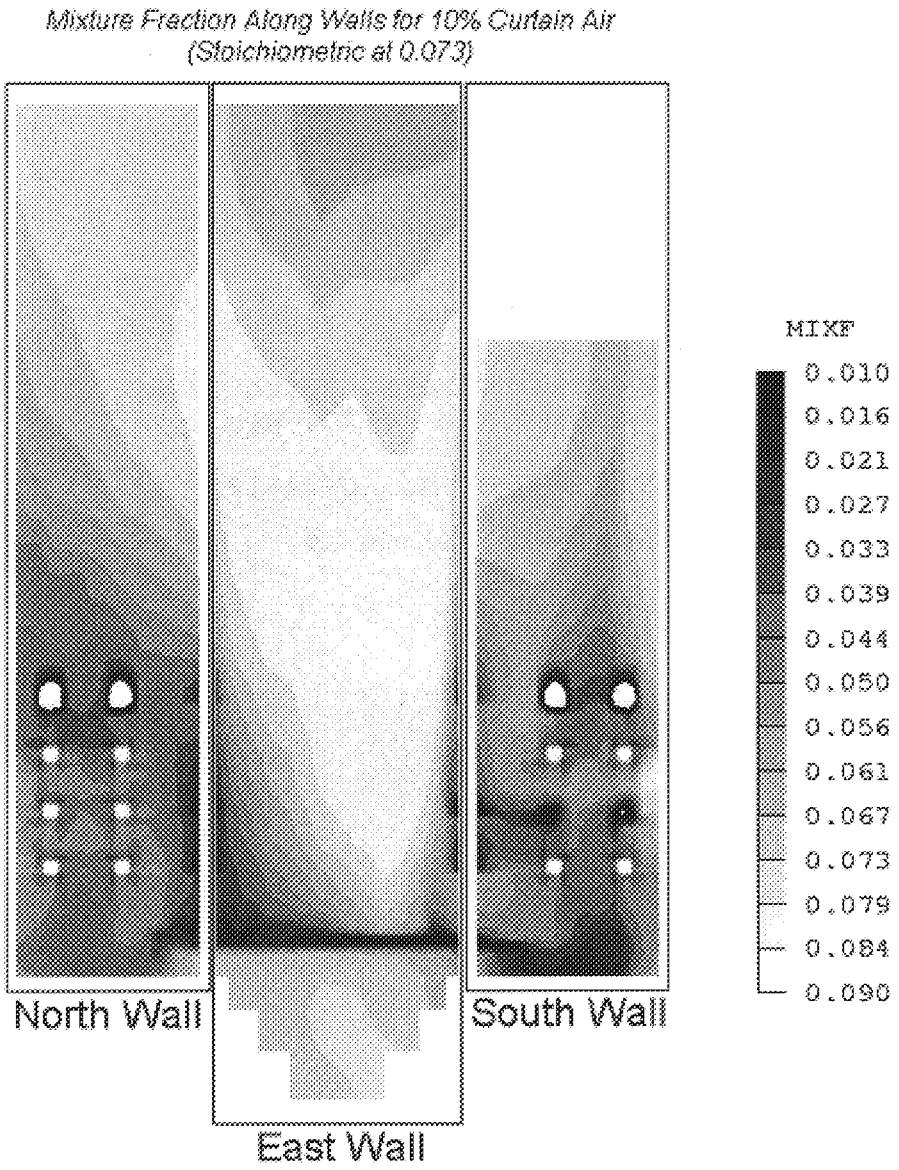
FIG. 14 shows the contours of the fuel mixture fractions of the atmosphere contacting the front (north), rear (south) and side (east) walls of a boiler when operated under the conditions of Example 6.

Example 6 shows the introduction of side wall slot air through a new location. This location is shown on FIG. 13, approximately 32 feet above the furnace hopper (Elevation 450'). This proposed "curtain air" would be introduced through slots cut in the waterwall webbing. This was simulated in the model by introducing air uniformly across the furnace width.

For this case, the curtain air flow was set to 10% of the secondary air, or 8.6% of the total air. The existing boundary air was left at 1.3% of total air. The curtain air was modelled as being redirected from the overfire air, not the burners. The conditions for the case are summarized in the table below.

| Example 6 | |
|---|---|
| Load | 640 MW |
| Exit $O_2$ | 3.0 |
| Boundary Air | 1.3% |
| Curtain Air | 8.6% of total |
| OFA | 17% |
| Fuel Rich Area | 7,061 $ft^2$ |
| Exit $NO_x$ | 322 ppm |
| Exit $NO_x$ | 0.447 lb/$10^6$ Btu |

EXAMPLE 7

Figure 15:
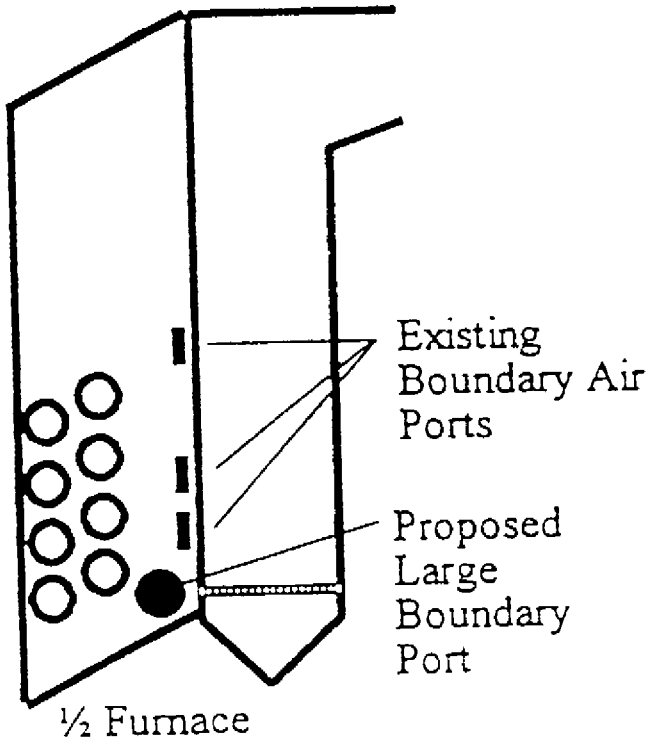
FIG. 15 shows a utility boiler having standard boundary air ports and a large boundary air port as indicated by Example 7, with side wall slots positioned to introduce side wall air at a location effective to be pushed upward by the updraft from the burners.
Figure 16:
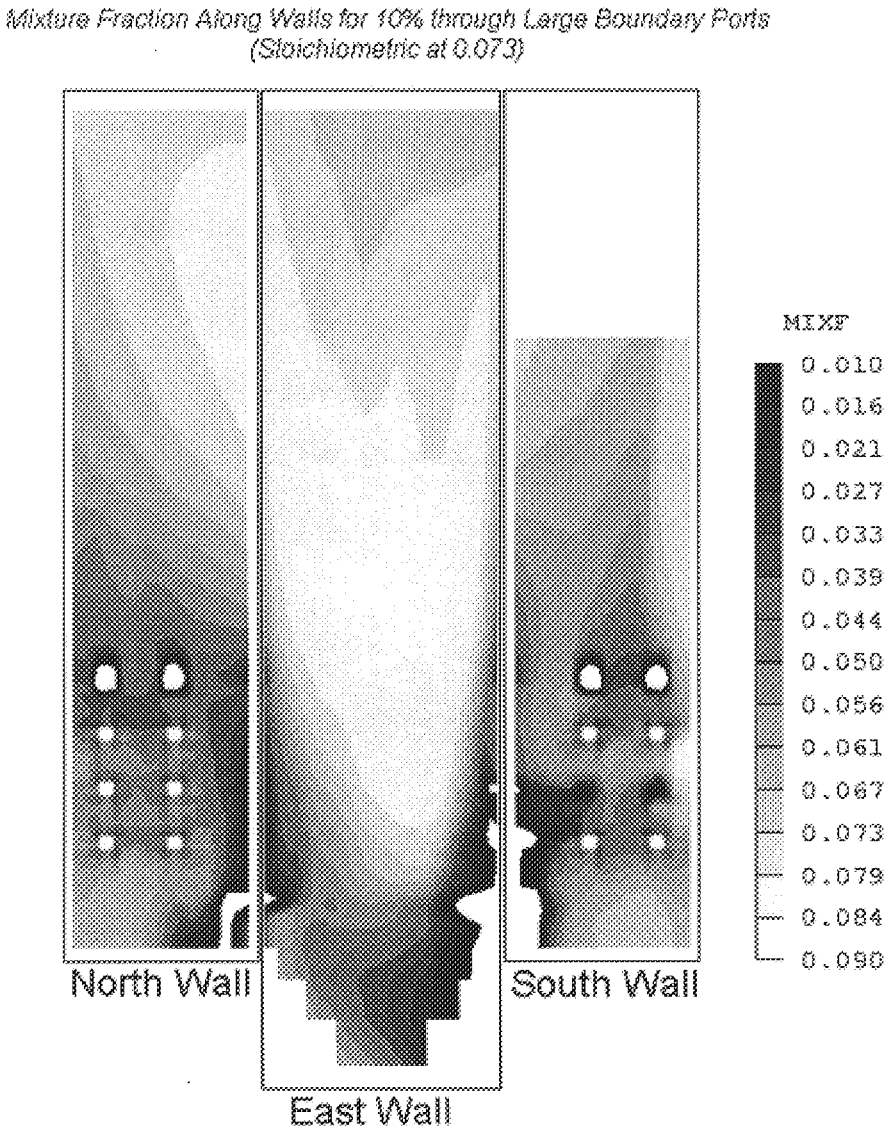
FIG. 16 shows the contours of the fuel mixture fractions of the atmosphere contacting the front (north), rear (south) and side (east) walls of a boiler when operated under the conditions of Example 7.
Figure 17:
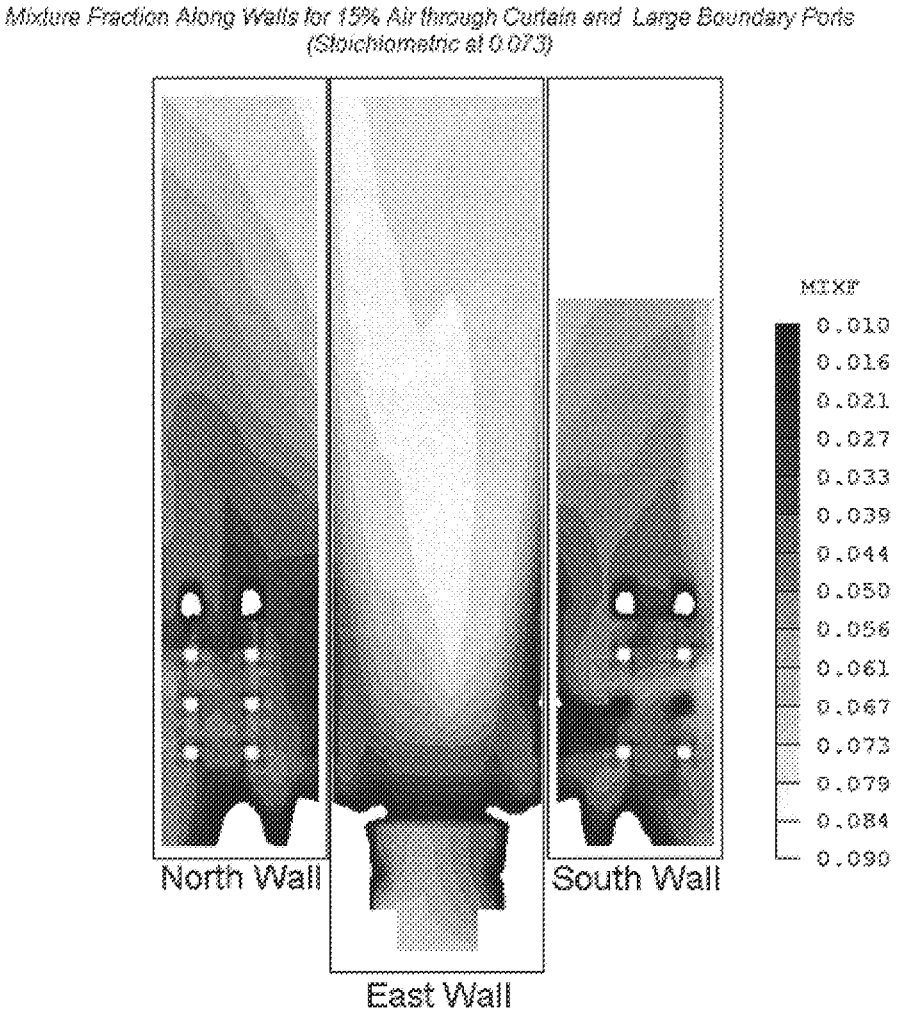
FIG. 17 shows the contours of the fuel mixture fractions of the atmosphere contacting the front (north), rear (south) and side (east) walls of a boiler when operated under the conditions of Example 8.

Example 7 shows the introduction of air through a new, large, boundary air port. The location of the large boundary port is shown on FIG. 15.

For this example, the large boundary air port flow was set to 10% of the secondary air, or 8.5% of the total air. As with the previous case, the existing boundary air was left at 1.3%. The conditions for the case are summarized in the table below.

| Example 7 | |
|---|---|
| Load | 640 MW |
| Exit $O_2$ | 3.0 |
| Boundary Air | 1.3% |
| Curtain Air | None |
| Large Bound. Port | 8.5% |
| OFA | 18% |
| Fuel Rich Area | 6,931 $ft^2$ |
| Exit $NO_x$ | 317 ppm |
| Exit $NO_x$ | 0.440 lb/$10^6$ Btu |

The introduction of air through the large boundary ports produces a slight reduction in the area exposed to reducing conditions.

EXAMPLE 8

Example 8 combines the solutions from Examples 6 and 7. For this example, the large boundary air ports and the side wall slots were both employed. The diverted air represented 15% of the secondary air, or 12.8% of the total air flow. The conditions for the case are summarized in the table below.

| Example 8 | |
|---|---|
| Load | 640 MW |
| Exit $O_2$ | 3.0 |
| Boundary Air | 1.3% |
| Curtain Air | 6.3% |

-continued

| Example 8 | |
|---|---|
| Large Bound. Port | 6.3% |
| OFA | 12.6% |
| Fuel Rich Area | 5,608 $ft^2$ |
| Exit $NO_x$ | 386 ppm |
| Exit $NO_x$ | 0.540 lb/$10^6$ Btu |

The diverted air was evenly distributed between the side wall air slots and the large boundary air ports. The existing boundary air ports were unchanged. The table shows that this large diversion of air had a substantial impact on the $NO_x$ emission.

Predictably, the large amount of air introduced reduces the area exposed to reducing conditions. When compared to Examples 6 or 7, Example 8 also shows a decrease in the magnitude of the reducing conditions.

EXAMPLE 9

Example 9 shows an increase in the amount of air introduced through the side wall air slots. For this case, the curtain air flow (provided through the side wall slots) was increased to 20% of the secondary air, or 17% of the total air. The conditions for the case are summarized in the table below.

| Example 9 | |
|---|---|
| Load | 640 MW |
| Exit $O_2$ | 3.0 |
| Boundary Air | 1.3% |
| Curtain Air | 17% |
| Large Bound. Port | None |
| OFA | 8.2% |
| Fuel Rich Area | 5,155 $ft^2$ |
| Exit $NO_x$ | 347 ppm |
| Exit $NO_x$ | 0.482 lb/$10^6$ Btu |

The increased air flow has drastically limited the area exposed to reducing conditions in the burner zone, but has had limited additional effect (compared to Example 2) in the upper furnace.

EXAMPLE 10

Example 10 shows an increase in the large boundary port air. For this case, the large boundary port air flow was increased to 20% of the secondary air, or 17% of the total air. The conditions for this example are summarized in the following table.

| Example 10 | |
|---|---|
| Load | 640 MW |
| Exit $O_2$ | 3.0 |
| Boundary Air | 1.3% |
| Curtain Air | None |
| Large Bound. Port | 17% |
| OFA | 8.2% |
| Fuel Rich Area | 5,737 $ft^2$ |
| Exit $NO_x$ | 347 ppm |
| Exit $NO_x$ | 0.482 lb/$10^6$ Btu |

The increase in the large boundary port air limits the reducing conditions along the side wall. No trace remains of the strongly reducing conditions present with Example 3 (mixture fraction above 0.084). Square feet of reducing conditions has been reduced as shown in the table for Example 10.

However, the diversion of such a large proportion of the air has adversely affected the $NO_x$ emissions. This is caused by some of the boundary air mixing back into the main burner zone, effectively reducing the staged combustion.

EXAMPLE 11

Example 11 repeats Example 8, but with the amount of air introduced through the side wall slots and large boundary ports being increased. For this example, the air flow was increased to 20% of the secondary air, or 17% of the total air. The air flow was divided evenly between the side wall air slots and the large boundary ports. The conditions for the case are summarized in the table below.

| Example 11 | |
|---|---|
| Load | 640 MW |
| Exit $O_2$ | 3.0 |
| Boundary Air | 1.3% |
| Curtain Air | 8.5% |
| Large Bound. Port | 8.5% |
| OFA | 8.2% |
| Fuel Rich Area | 3,433 $ft^2$ |
| Exit $NO_x$ | 450 ppm |
| Exit $NO_x$ | 0.625 lb/$10^6$ Btu |

Similar to Example 10, the Example 11 configuration also raised the $NO_x$ emission. However, this configuration substantially limited the area exposed to reducing conditions. The combination of increased curtain and large boundary port air has entirely removed reducing conditions at the burner region elevation. Reducing conditions still remain along the wall in the upper regions of the furnace.

EXAMPLE 12

Example 12 duplicates the conditions of Example 6, but with the side wall slots being raised to a higher elevation. For this case, the curtain air flow was maintained (relative to Example 4) at 10% of the secondary air, or 8.5% of the total air. The location of the side wall slots was raised to the 475 foot elevation. In the prior examples, the side wall slots had been provided at the 458–460 foot elevation. The lowermost burners are located at the 470 foot elevation, while the boiler floor is at 426 feet. The top of the hopper is at 452 feet.

It can be seen that the change in position of the curtain air has a drastic effect on the reducing conditions along the side wall. Almost the entire wall has had the magnitude of reducing conditions lowered from Example 6 (mixture fraction reduced below 0.079). The conditions for the case are summarized in the table below.

| Example 12 | |
|---|---|
| Load | 640 MW |
| Exit $O_2$ | 3.0 |
| Boundary Air | 1.3% |
| Curtain Air | 8.5% |
| Large Bound. Port | None |
| OFA | 17% |
| Fuel Rich Area | 5,091 $ft^2$ |
| Exit $NO_x$ | 314 ppm |
| Exit $NO_x$ | 0.436 lb/$10^6$ Btu |

Below the burner zone, there is found an elevation where the flow up the side wall is relatively stagnant. As the elevation increase,s the flow increases in upward velocity, picking up momentum from the burner flows Example 12 higher, in the faster flow regions, than Example 6. This causes more of the air to flow back and coat the side wall.

EXAMPLE 13

Example 13 shows a change in the distribution of air introduced through the existing boundary air ports. Similar to Example 5, the existing boundary air flow was increased to 10% of the secondary air, or 8.5% of the total air, but for Example 13, only the bottom two boundary ports were employed. The conditions for the case are summarized in the table below.

| Example 13 | |
|---|---|
| Load | 640 MW |
| Exit $O_2$ | 3.0 |
| Boundary Air | 8.5% |
| Curtain Air | None |
| Large Bound. Port | None |
| OFA | 18% |
| Fuel Rich Area | 3,778 $ft^2$ |
| Exit $NO_x$ | 306 ppm |
| Exit $NO_x$ | 0.425 lb/$10^6$ Btu |

The shift in the air location has reduced the area exposed to reducing conditions (as shown in the table above), but has not eliminated the strongly reducing condition in the lower furnace observed in Example 5.

EXAMPLE 14

Example 14 shows the side wall slots being located mid-way between the elevations for Examples 6 and 12. For this case, the curtain air flow was maintain at 10% of the secondary air, or 8.5% of the total air. The conditions for the example are summarized in the table below.

| Example 14 | |
|---|---|
| Load | 640 MW |
| Exit $O_2$ | 3.0 |
| Boundary Air | 1.3% |
| Curtain Air | 8.5% |
| Large Bound. Port | None |
| OFA | 17% |
| Fuel Rich Area | 6,017 $ft^2$ |
| Exit $NO_x$ | 325 ppm |
| Exit $NO_x$ | 0.451 lb/$10^6$ Btu |

The curtain air at the 460' elevation has produced a strong compromise between Examples 6 and 12. It has the same profile at the elevation of the burner region as Example 12, but limits the strong reducing zone found in Example 12 below the burners. Example 14 has higher magnitude of reducing conditions in the upper furnace than Example 12, but is an improvement over Example 6.

EXAMPLE 15

Example 15 repeats Example 14, but with the amount of air introduced through the side wall air slots decreased. For this case, the curtain air flow was decreased to 5% of the secondary air, or 4.1% of the total air. The conditions for the case are summarized in the table below.

| Example 15 | |
|---|---|
| Load | 640 MW |
| Exit $O_2$ | 3.0 |
| Boundary Air | 1.3% |
| Curtain Air | 4.1% |

-continued

| Example 15 | |
|---|---|
| Large Bound. Port | None |
| OFA | 21% |
| Fuel Rich Area | 6,469 $ft^2$ |
| Exit $NO_x$ | 311 ppm |
| Exit $NO_x$ | 0.432 lb/$10^6$ Btu |

Example 15 was run to determine if introduction of less air at the 460' elevation could produce the same effect as more air at the 450' elevation.

EXAMPLE 16

Example 16 shows two levels of side wall air slots. For this case, the curtain air flow was increased to 15%. Ten percent of the secondary air, or 8.5% of the total air, was introduced through side wall air slots at the 450' elevation and 5% of secondary, or 4.3% of total, through slots at the 475' elevation. The conditions for the case are summarized in the table below.

| Example 16 | |
|---|---|
| Load | 640 MW |
| Exit $O_2$ | 3.0 |
| Boundary Air | 1.3% |
| Curtain Air at 450' | 8.5% |
| Curtain Air at 475' | 4.3% |
| OFA | 12.5% |
| Fuel Rich Area | 4,424 $ft^2$ |
| Exit $NO_x$ | 326 ppm |
| Exit $NO_x$ | 0.453 lb/$10^6$ Btu |

Example 16 was performed to compare to Example 12. The two levels of curtain air at 15% produce a comparable profile to the 15% through both curtain air slots and large boundary ports.

It can be seen from the above that two design criteria are established:

(1) removal of the area above 0.084 mixture fraction (i.e., removal of the area having a fuel mixture ratio of more than 115% of the stoichiometric ratio); and (2) limitation of area exposed to reducing conditions.

Based on these criteria, the following conclusions may be drawn from the case series:

A. Examples 5 and 14 show that increasing the mass flow through the existing ports is unsuccessful at removing the strong reducing conditions. However, Example 14 does very well at reducing the size of the area exposed to reducing conditions.

B. Examples 6 and 7 represent the same amount of air introduced through two different methods. Both completely eliminate the region exposed to strong reducing conditions. Neither has much impact on the total area exposed to reducing conditions, or on the $NO_x$ emission.

C. Comparison of Examples 5, 6 and 7 to Examples 9 and 10 shows that as the air flow increases, the curtain air port design performs better than the large boundary air port. Example 9 (curtain air slots) has reduced the fuel rich area from 7,050 $ft^2$ to 5,155 $ft^2$, while Example 10 (large boundary ports) has only reduced it to 5,737 $ft^2$, for the same amount of air.

D. Comparison of Example 8 to Examples 6 through 10 shows that the combination of boundary air ports and curtain air slots has a significantly greater impact on $NO_x$ than either ports/slots alone. Example 8 diverts 12.8% of the air to the ports while raising $NO_x$ to 386 ppm, while Examples 9 and 10 divert 17% of the air with a $NO_x$ emission of only 347 ppm.

E. Example 11 shows that the combination of large boundary air and curtain air with 17% of the air actually increases the $NO_x$ above the levels attained with no overfire air. This would indicate that the 17% air is mixing back into the main burner zone.

Figure 18:
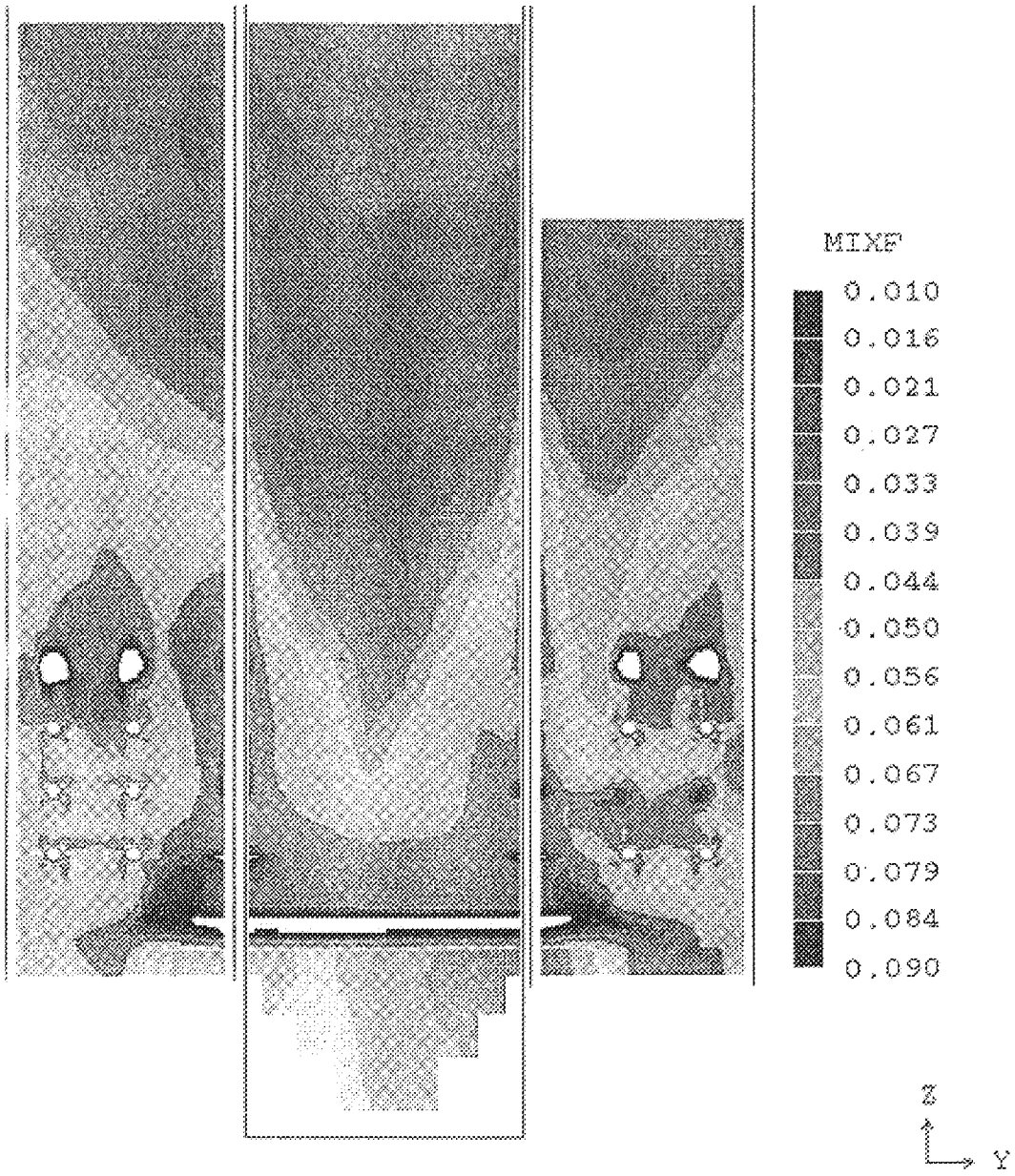
FIG. 18 shows the contours of the fuel mixture fractions of the atmosphere contacting the front (north), rear (south) and side (east) walls of a boiler when operated under the conditions of Example 9.
Figure 19:
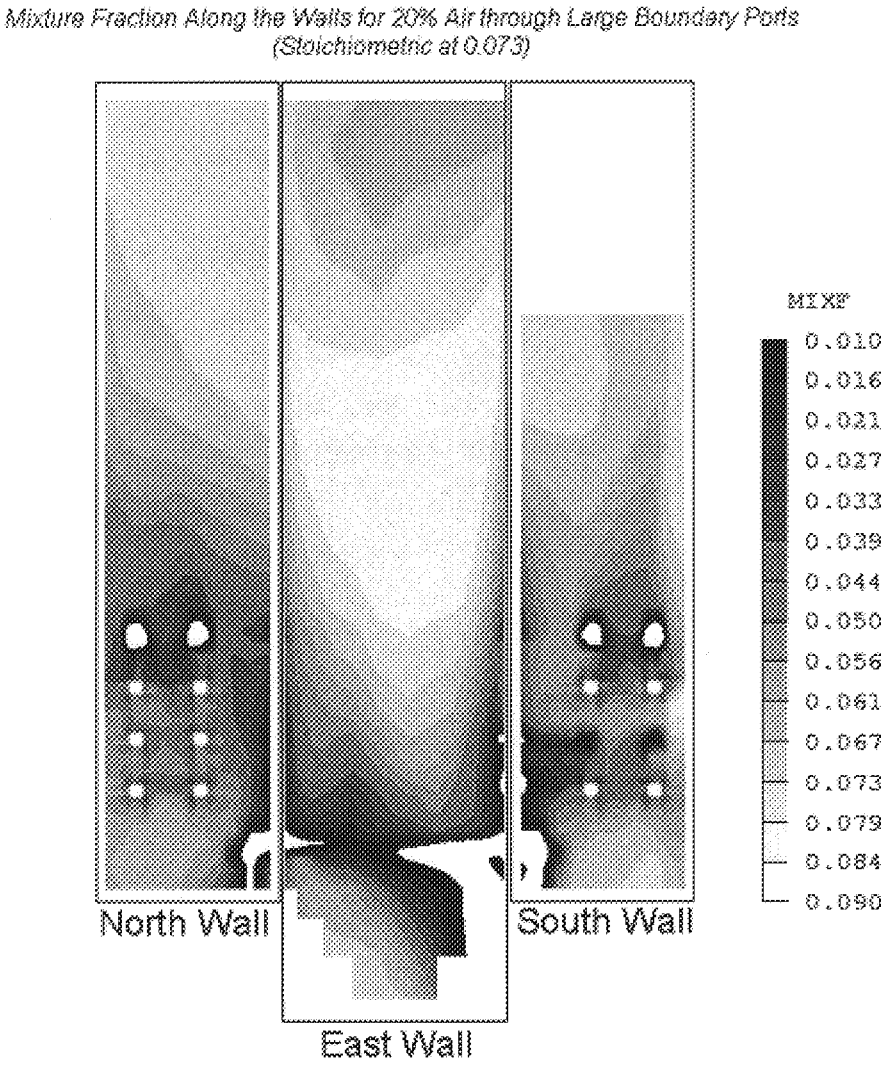
FIG. 19 shows the contours of the fuel mixture fractions of the atmosphere contacting the front (north), rear (south) and side (east) walls of a boiler when operated under the conditions of Example 10.
Figure 20:
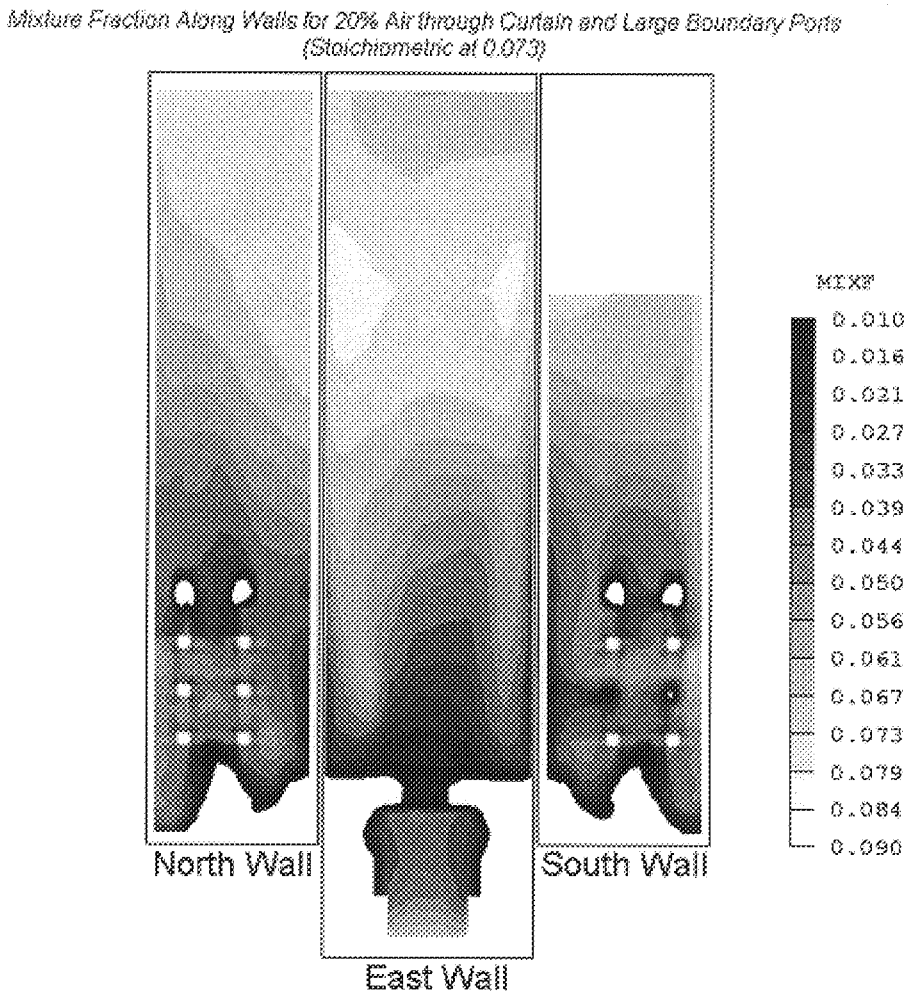
FIG. 20 shows the contours of the fuel mixture fractions of the atmosphere contacting the front (north), rear (south) and side (east) walls of a boiler when operated under the conditions of Example 11.
Figure 21:
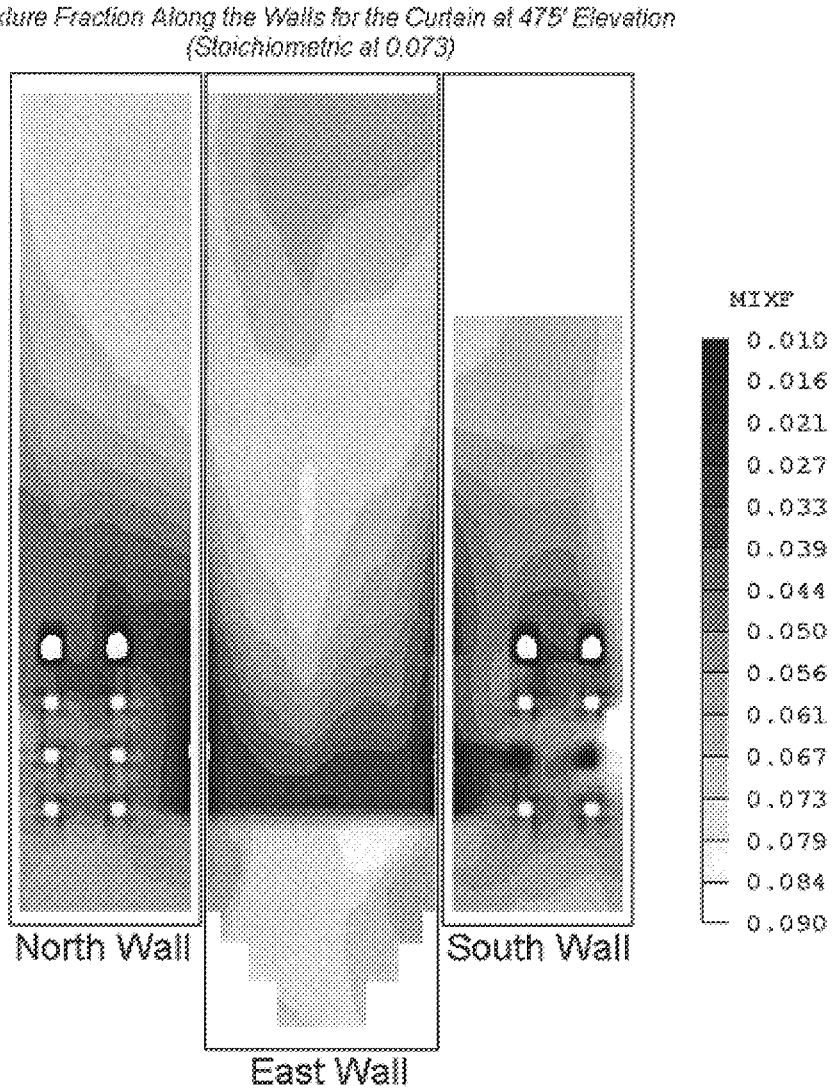
FIG. 21 shows the contours of the fuel mixture fractions of the atmosphere contacting the front (north), rear (south) and side (east) walls of a boiler when operated under the conditions of Example 12.
Figure 22:
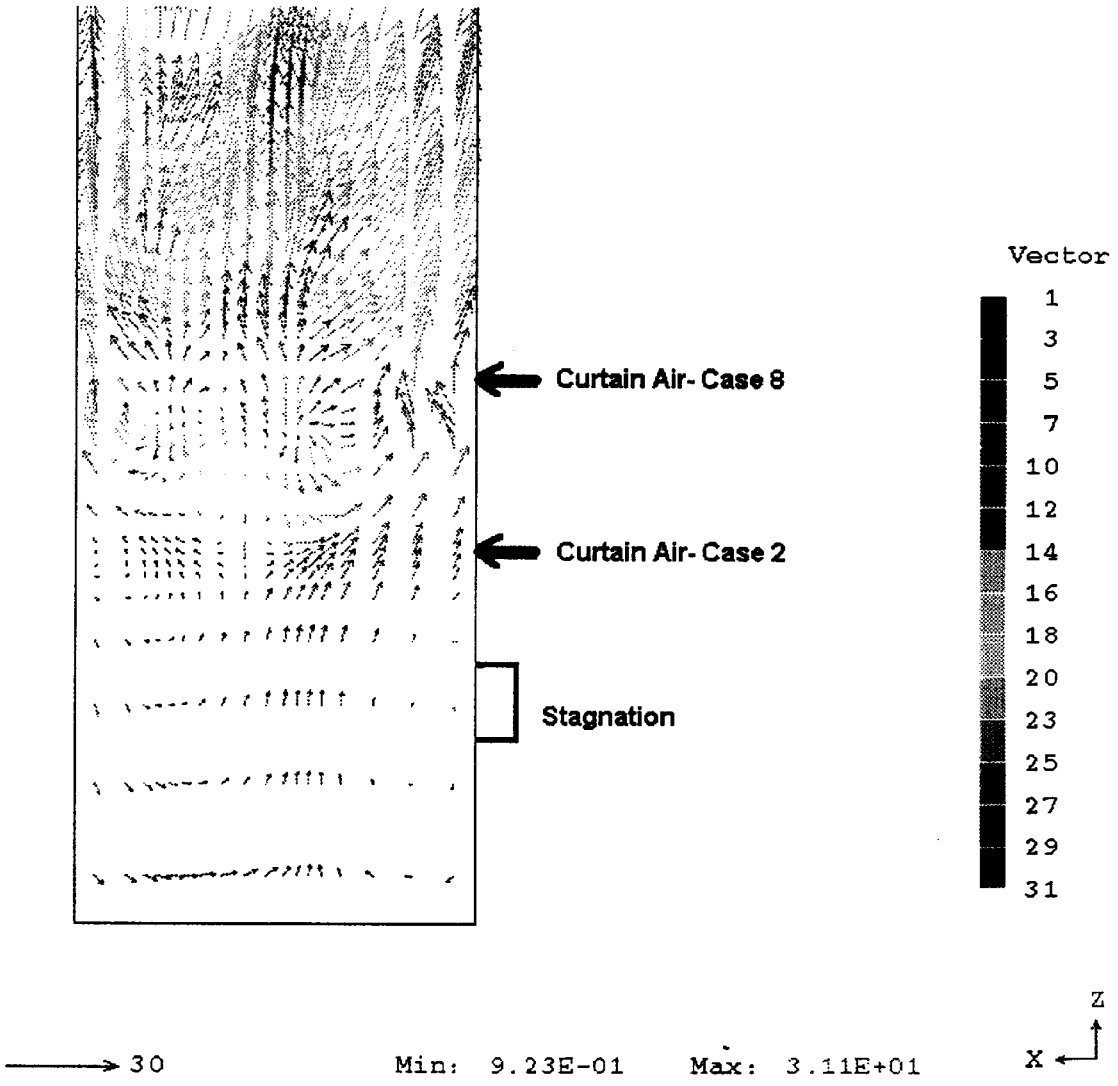
FIG. 22 shows the flow field with the side wall slots located as in Example 12 (i.e., at the midpoint between the firing faces) and showing how, below the burner zone, there is an elevation where the flow up the side wall is relatively stagnant, while, as elevation increases, the flow increases in upward velocity as momentum is gained from the burner flow.
Figure 23:
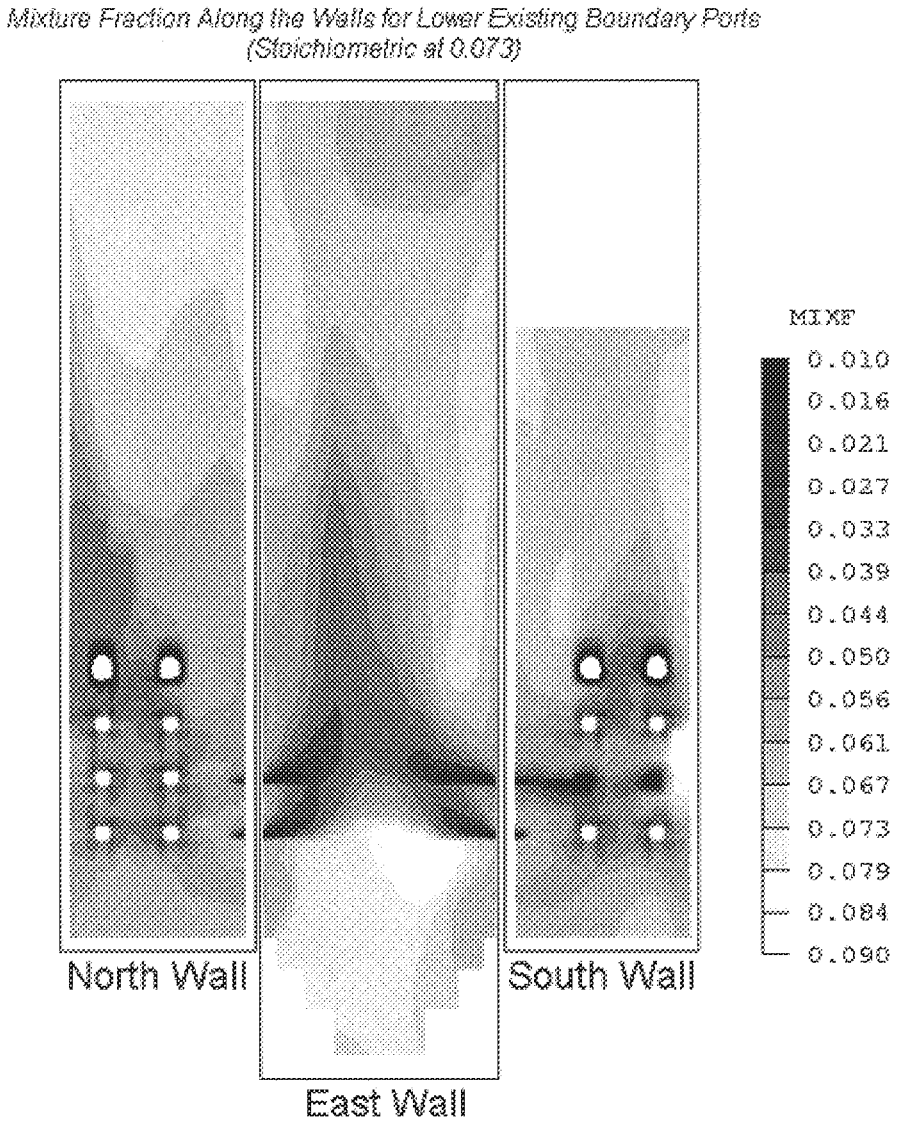
FIG. 23 shows the contours of the fuel mixture fractions of the atmosphere contacting the front (north), rear (south) and side (east) walls of a boiler when operated under the conditions of Example 13.
Figure 24:
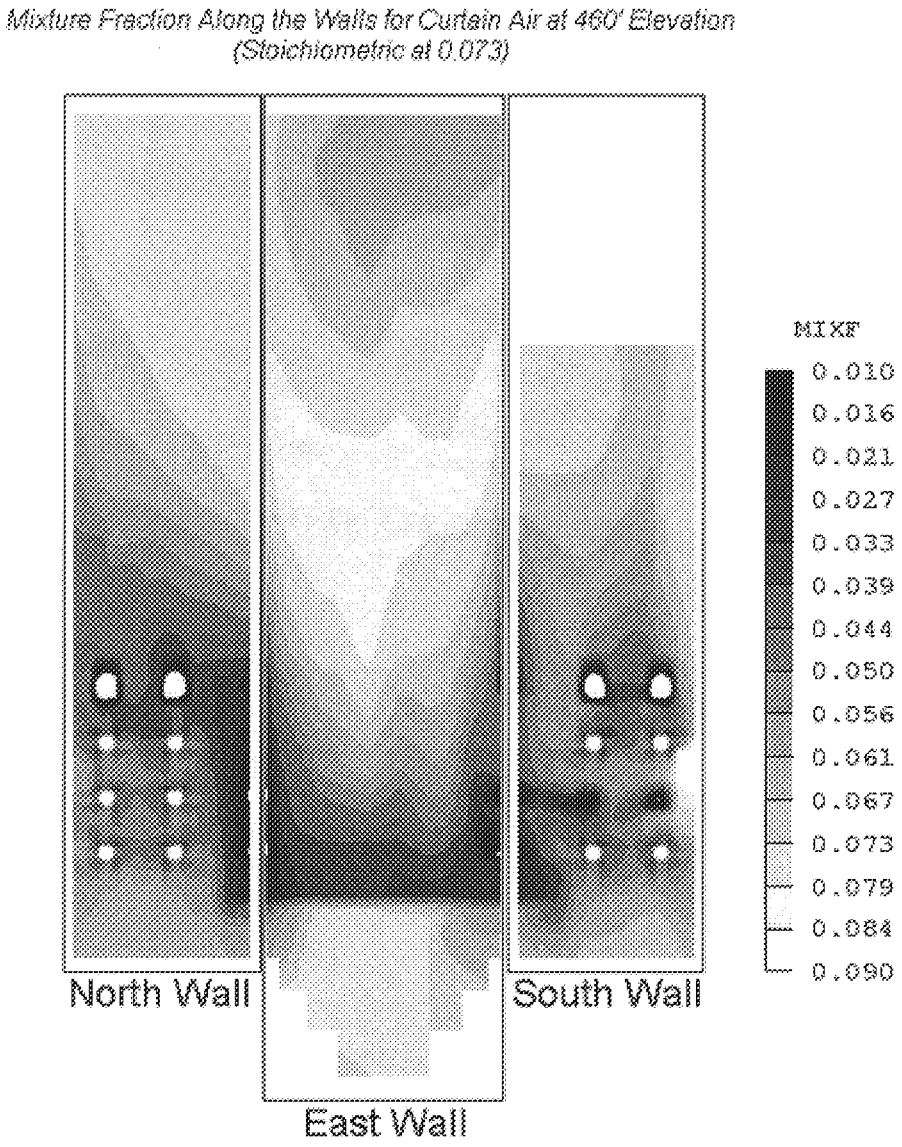
FIG. 24 shows the contours of the fuel mixture fractions of the atmosphere contacting the front (north), rear (south) and side (east) walls of a boiler when operated under the conditions of Example 14.
Figure 25:
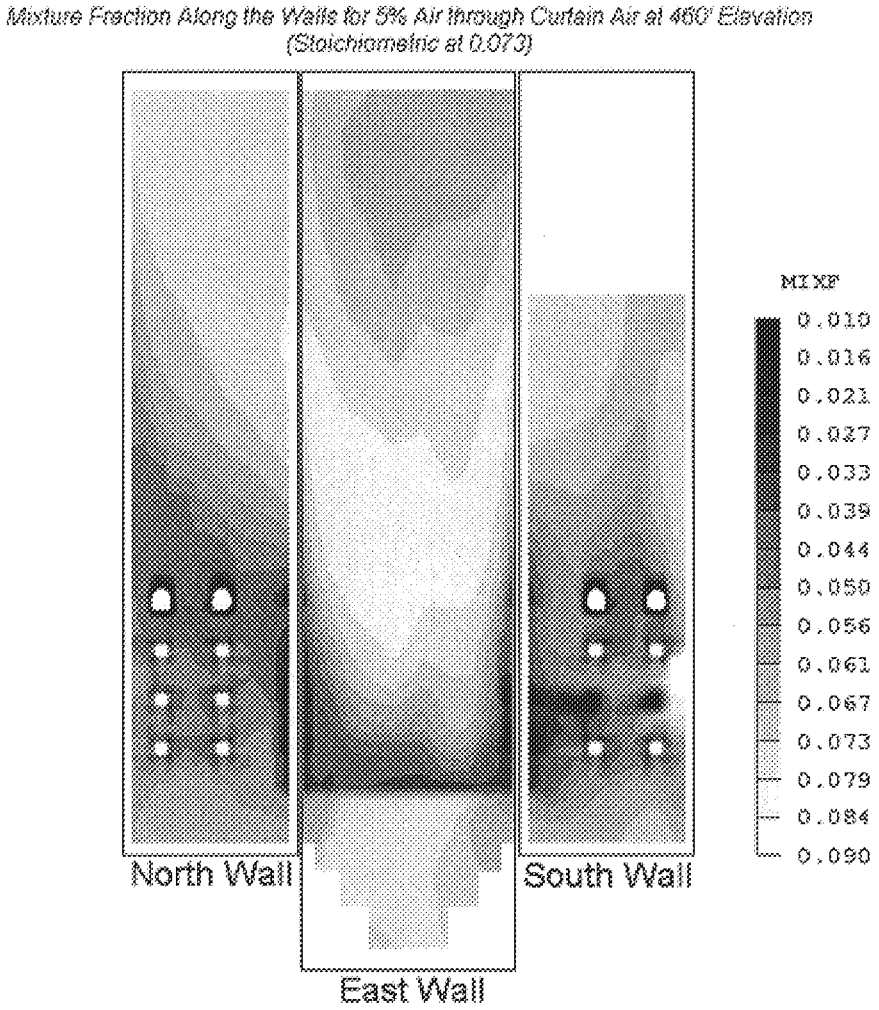
FIG. 25 shows the contours of the fuel mixture fractions of the atmosphere contacting the front (north), rear (south) and side (east) walls of a boiler when operated under the conditions of Example 15.
Figure 26:
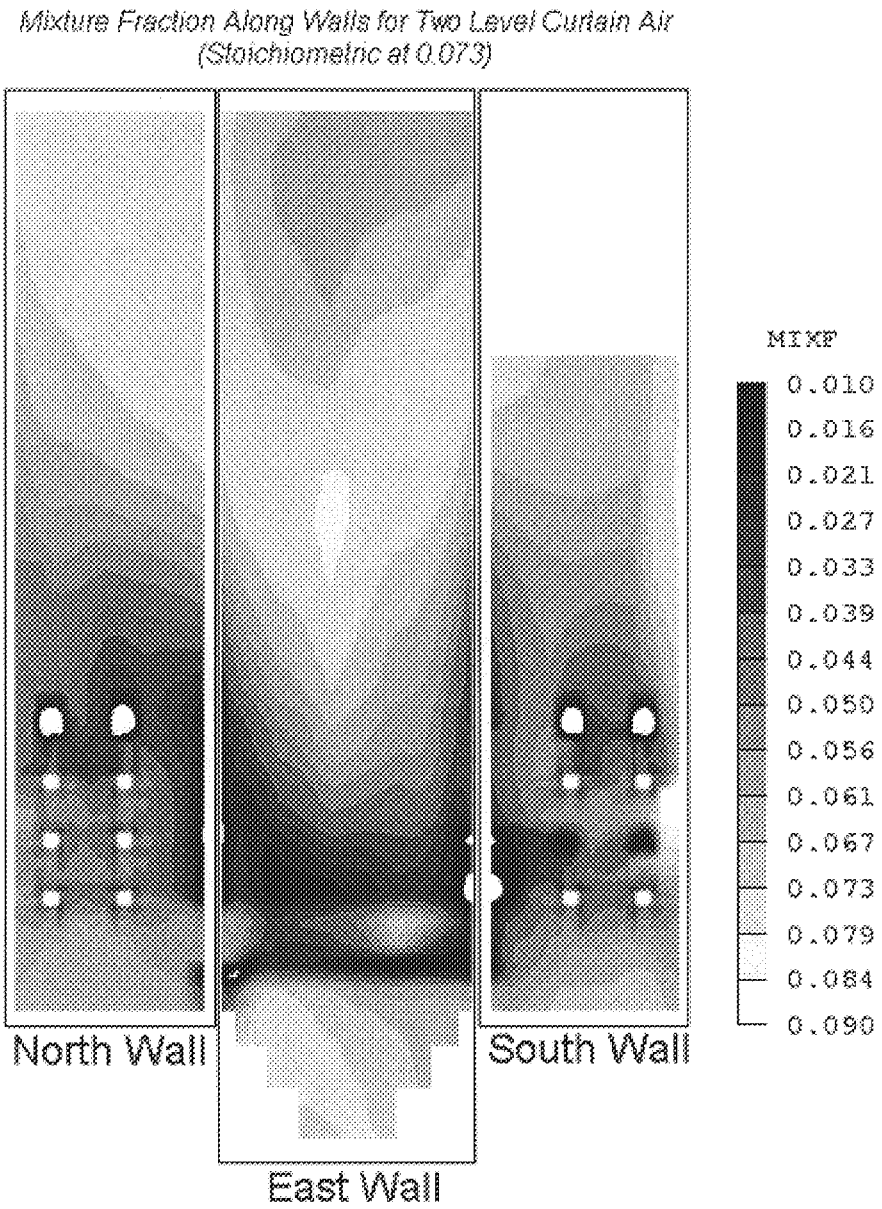
FIG. 26 shows the contours of the fuel mixture fractions of the atmosphere contacting the front (north), rear (south) and side (east) walls of a boiler when operated under the conditions of Example 16.

F. Comparison of Example 12 to Example 7 shows that increasing the height at which the curtain air is introduced produces the same benefits as increasing the flow at the lower elevation, while producing lower $NO_x$ emissions. Moreover, comparison of FIGS. 18 and 21 shows that while both have about the same square footage of reducing conditions, example 12 has a lower overall magnitude of reducing conditions.

G. Examples 6, 12, and 14 show an almost linear dependence of area exposed to reducing conditions to the height of the curtain air slots.

H. Examples 15 and 16 further show that less air is required at a greater elevation for the same square footage of reducing conditions when using the curtain air slot design.

Accordingly, in the present invention the side wall air slots are placed as close to the burner zone elevation as possible. With this placement the protective curtain of air is introduced into the boiler at a location effective to be propelled upward by the updraft from the burners, and thereby to provide a curtain of air to protect the side walls from corrosion.

While the invention has been illustrated and described in detail in the foregoing description, the same is to be considered as illustrative and not restrictive in character, it being understood that only the preferred embodiment has been shown and described and that all changes and modifications that come within the spirit of the invention are desired to be protected.

What is claimed is:

1. A method of reducing the rate of side wall corrosion in a coal-fired utility boiler, said boiler comprising a pair of burner walls, a pair of side walls and a floor, at least one of said burner walls including a plurality of burners for introducing a combustible mixture of pulverized coal and air into the boiler; said method comprising:

(a) providing a plurality of side wall slots in at least one of said side walls, said side wall slots being located substantially above said boiler floor; and (b) introducing a flow of side wall air into the boiler through said side wall slots;

wherein said side wall air is introduced into the boiler at a location effective to be propelled upward by the updraft from the burners, and thereby to provide a curtain of air to protect the side walls from corrosion.

2. The method of claim 1 wherein said side wall slots are located in a first substantially horizontal row at an elevation substantially equal to the elevation of the lowermost boiler burners.

3. The method of claim 2, and additionally providing and utilizing a second substantially horizontal row of side wall slots, said second row of side wall slots being at an elevation substantially above the elevation of the lowermost boiler burners.

4. The method of claim 1 wherein said side wall slots are located in a convex upward arc, with the lowermost slots being at an elevation substantially equal to, or above, the elevation of the lowermost boiler burners.

5. The method of claim 1, and additionally providing and utilizing side wall slots at an elevation below the elevation of the lowermost boiler burners.

6. The method of claim 1, and additionally providing and utilizing at least one boundary air port to introduce boundary air into the boiler.

7. The method of claim 1, and additionally providing and utilizing at least one overfire air port to introduce overfire air into the boiler.

8. The method of claim 7 wherein said overfire air ports introduce up to about 20% of the secondary air into the boiler.

9. A method of reducing the rate of side wall corrosion in a coal-fired utility boiler while maintaining reduced $NO_x$ emission levels, said coal-fired utility boiler comprising a plurality of walls interconnected to form an enclosure, wherein at least one of said walls includes a plurality of burners for introducing a mixture of pulverized coal and primary air into the boiler, said coal-fired utility boiler additionally comprising at least one overfire air port for introducing overfire air into the boiler; said method comprising:

(a) providing a plurality of curtain air ports in at least one of said walls;

(b) injecting a stream of pulverized coal and a sub-stoichiometric amount of primary air into the boiler through said burners;

(c) combusting said stream of pulverized coal and primary air in the boiler;

(d) introducing overfire air into the boiler through said at least one overfire air port, wherein said overfire air comprises between about 5% and about 20% of the total air provided to the boiler;

(e) introducing curtain air into the boiler through said curtain air ports, wherein said curtain air comprises between about 5% and about 20% of the total air provided to the boiler; and (f) balancing the flow of air through said overfire air port(s) and said curtain air ports such that the ratio of curtain air to overfire air is small enough to maintain combustion staging and assure $NO_x$ emission levels of less than about 0.50 lbs. per $10^6$ Btu, yet is large enough to maintain a fuel mixture ratio of less than about 115% of the stoichiometric ratio in the atmosphere adjacent to said walls.

10. A method of reducing the rate of side wall corrosion in a coal-fired utility boiler, said boiler comprising a pair of burner walls, a pair of side walls and a floor, at least one of said burner walls including a plurality of burners for introducing a combustible mixture of pulverized coal and air into the boiler; said method comprising:

(a) providing a plurality of side wall slots in at least one of said side walls, said side wall slots being located at an elevation approximately 10 to 12 feet below the lowermost burners and substantially above said boiler floor; and (b) introducing a flow of side wall air into the boiler through said side wall slots;

wherein said side wall air is introduced into the boiler at a location effective to be propelled upward by the updraft from the burners, and thereby to provide a curtain of air to protect the side walls from corrosion.

* * * * *

UNITED STATES PATENT AND TRADEMARK OFFICE

CERTIFICATE OF CORRECTION

PATENT NO : 5,809,913

DATED : September 22, 1998

INVENTOR(S) : Edward D. Kramer et al.

It is certified that error appears in the above-identified patent and that said Letters Patent is hereby corrected as shown below:

On the title page, Item [56], line 6, please change "110/263" to --110/265--.

Signed and Sealed this

Eighteenth Day of May, 1999

*Attest:*

Q. TODD DICKINSON

*Attesting Officer*

*Acting Commissioner of Patents and Trademarks*